United States Patent [19]

Chadwick, II

[11] Patent Number: 4,492,723

[45] Date of Patent: Jan. 8, 1985

[54] CURVILINEAR POLYHEDRAL CONSTRUCTION KIT

[76] Inventor: Lee S. Chadwick, II, R.F.D. #2 Box 138, Randolph, Vt. 05060

[21] Appl. No.: 434,175

[22] Filed: Oct. 14, 1982

[51] Int. Cl.[3] ..... A63H 33/16

[52] U.S. Cl. ..... 428/7; 428/8; 428/9; 428/11; 446/488

[58] Field of Search ..... 46/1 L, 30; 428/7, 8, 428/9, 10, 11

[56] References Cited

U.S. PATENT DOCUMENTS

| | | | |
|---|---|---|---|
| 2,404,941 | 7/1946 | Beckelman | 46/1 L |
| 2,509,397 | 5/1950 | Paige | 40/124.1 |
| 2,966,757 | 1/1961 | Faulk | 428/11 |
| 3,181,260 | 5/1965 | Scherotto | 428/12 |
| 3,273,272 | 9/1966 | Paige | 40/124.1 |
| 3,510,974 | 5/1970 | Lane | 40/124.1 |
| 3,571,958 | 3/1971 | Stevens et al. | 428/7 |
| 3,614,835 | 10/1971 | Rice et al. | 35/34 |
| 3,630,430 | 12/1971 | Struble | 229/16 B |
| 3,656,256 | 4/1972 | Maskell et al. | 46/1 L |
| 3,668,796 | 6/1972 | Patterson | 40/126 A |
| 3,728,201 | 4/1973 | Stroehmer | 428/9 |
| 3,788,934 | 1/1974 | Coppa | 46/1 L |
| 4,001,964 | 1/1977 | Hooker | 428/9 |
| 4,037,354 | 7/1977 | ChaBakKuk | 46/1 L |
| 4,063,725 | 12/1977 | Snyder | 46/1 L |
| 4,084,015 | 4/1978 | Patterson | 428/9 |
| 4,142,321 | 3/1979 | Coppa | 46/1 L |
| 4,366,961 | 1/1983 | Busse | 46/1 L |

FOREIGN PATENT DOCUMENTS

| | | | |
|---|---|---|---|
| 2610178 | 9/1977 | Fed. Rep. of Germany | 156/63 |
| 211560 | 2/1924 | United Kingdom | |

*Primary Examiner*—John E. Kittle

*Attorney, Agent, or Firm*—Harvey E. Bumgardner, Jr.

[57] ABSTRACT

A construction kit for forming a variety of curvilinear faced polyhedrons all surfaces of which are arcuate and clusters of such polyhedrons from one or more of a variety of planar foldable polygonal components derived from arcuate lobed equilateral triangles, squares, rhombuses, pentagons and hexagons.

40 Claims, 73 Drawing Figures

FIG. 25a
FIG. 26
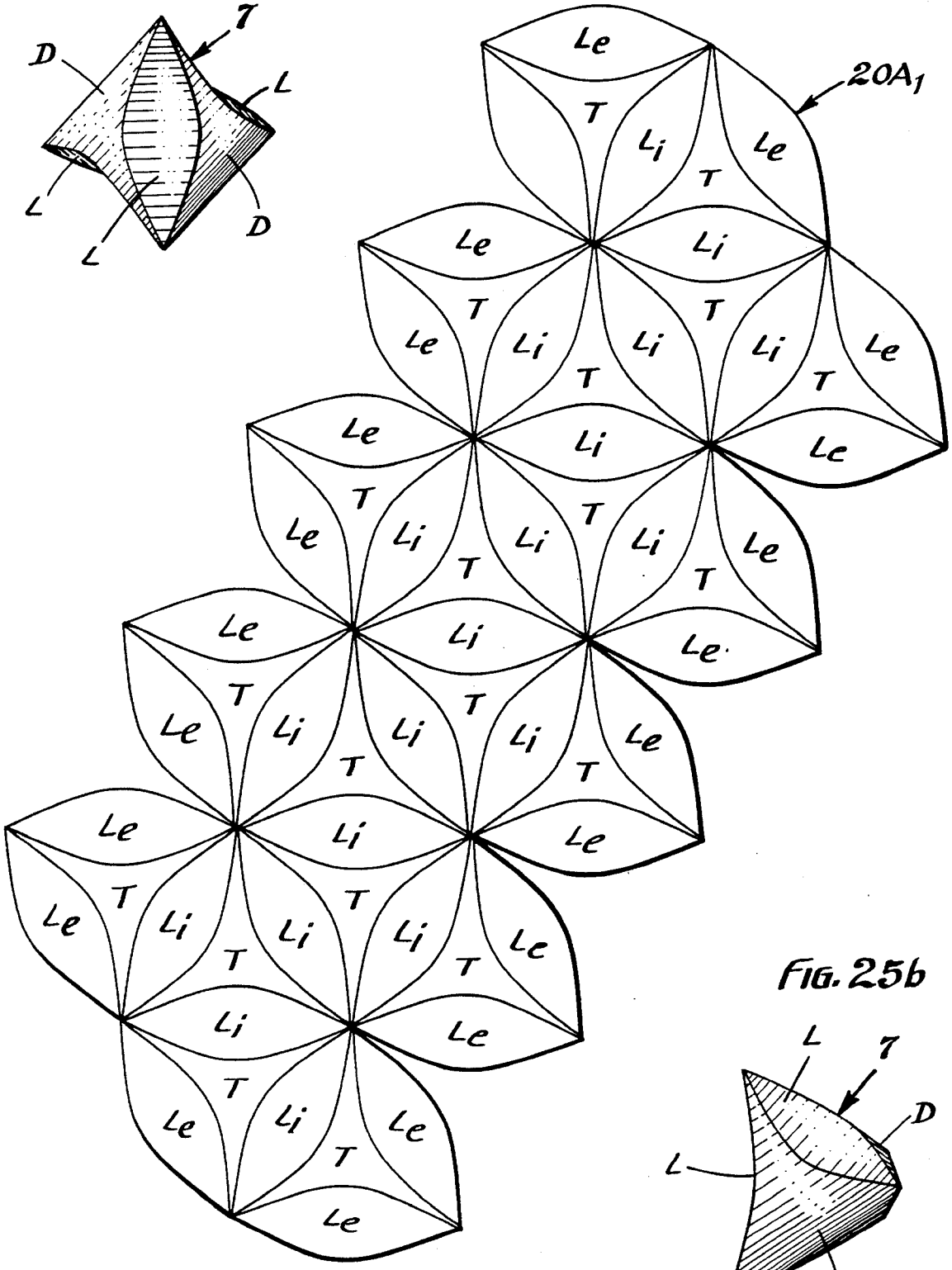
FIG. 25b
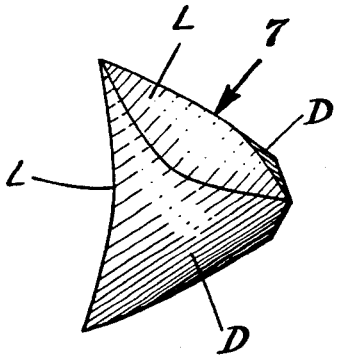

CURVILINEAR POLYHEDRAL CONSTRUCTION KIT

BACKGROUND AND OBJECTS OF THE INVENTION

This invention relates generally to hobby kits for the construction of a wide variety of decorative and useful three-dimensional objects from a select few basic foldable and bendable closed planar elements and from a variety of foldable and bendable closed planar components having outlines and interior scoring such as might be achieved by partially superimposing two or more of the basic elements. It is an important feature of the invention that all of the edges and surfaces of each of the aforementioned three-dimensional objects (monohedrons, polyhedrons and clusters thereof) are curvilinear.

The three-dimensional curvilinear structures of this invention are useful as room decorations, Christmas tree ornaments, lamp and chandelier shades, toys and many other functional objects.

Another object of the invention is to provide a planar object on which may be imprinted a greeting or other writing and which may be assembled into a Christmas tree ornament, a point-of-sale advertising display or a similar device.

BRIEF DESCRIPTION OF THE DRAWINGS

In the foregoing general description I have set out certain objects, purposes and advantages of my invention. Other objects, purposes and advantages will be apparent from a condieration of the following description and the accompanying drawings in which:

FIGS. 25*a*–25*b* are two different views of a rhombic bifacial polyhedron of the invention of a different form from that shown in FIG. 17;

FIG. 26 is a plan view of a twenty triangle planar component of the invention;

DESCRIPTION OF THE PREFERRED EMBODIMENT

The scope of this invention contemplates a wide variety of construction kits, some intended for the construction of specific curvilinear faced polyhedrons and clusters thereof and others containing a sufficient number and variety of planar component parts to permit construction of a plurality of such three-dimensional objects of the user's own choosing. All of such kits will, however, be founded upon component parts derived from one or more of the limited number of basic elements next described. The components of the kits may be formed from foldable paperboard or other suitable foldable, bendable and scorable material.

The basic elements of the construction kits of the preferred embodiment of the invention are principally related to four polygons, the equilateral triangle, the square, the equilateral pentagon and the equilateral rhombus formed by abutting two congruent equilateral triangles base to base (a "diamond"). As will be noted further hereinafter, a basic element related to an equilateral hexagon is also somewhat useful. Since all edges of the basic elements and component parts of the invention are curved in the plane of the polygons to which they are related and these basic elements are scored exclusively along curved lines as well, the related polygons must be modified to form the basic elements of the construction kits.

Figure 1:
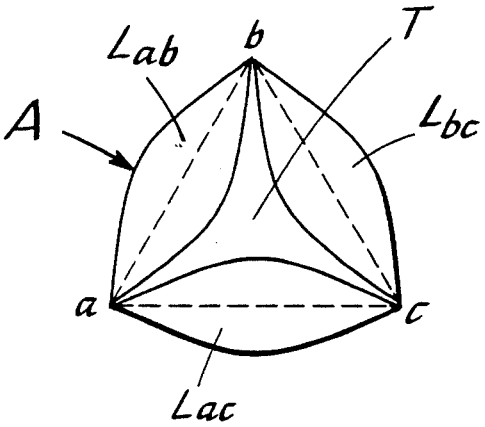
FIG. 1 is a plan view of a flat sheet showing how to construct the basic triangular element of the invention.

Considering first the equilateral triangle abc as drawn on paperboard and shown by dotted lines in FIG. 1, identical symmetrical arcs are added both interior and exterior to the respective sides ab, ac and bc of the triangle abc and intersecting the triangle, respectively, at points a, b and c. The exterior arcs ab, ac and bc define a three-lobed disc A (called a disc herein although it is not truly round) which encloses a more pointed three-sided figure T defined by the interior arcs ab, ac and bc. Each pair of arcs, exterior ab and interior ab for example, form a symmetrical lobe L the edges of which would coincide if the lobe $L_{ab}$ were to be folded about the straight line ab or folded perpendicular thereto so that point a is superimposed upon point b. The curves of the respective arcs ab, ac and bc may be circular or may be of any other suitable symmetrical form such as the hyperbolic arcs illustrated in FIG. 1. Otherwise appropriate symmetrical arcs of all conical sections may be useful.

The interior arcs defining the lobes $L_{ab}$, $L_{ac}$ and $L_{bc}$ should not be so acutely curved that they intersect each other at any point within the three-lobed disc A other than at points a, b and c. It has been found desirable to maintain an angle of about 6° between the tangents to the respective interior arcs at their points of intersection a, b and c. Conversely, the arcs ab, ac and bc, respectively, should not be of such shallow curvature as to approach each other and the respective straight sides of the triangle abc at midpoint thereby compromising the three-dimensional curved beauty of the objects to be formed from the components of the kits of the invention. It has been found that an interior curve ab having a midpoint extending inwardly approximately $\frac{1}{2}$ to $\frac{5}{8}$ of the distance between the side ab of the triangle abc and the center of triangle abc provides an optimum three-dimensional effect.

Figure 2:
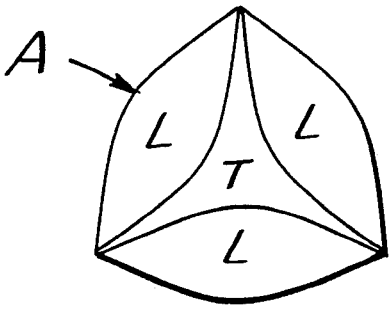
FIG. 2 is a plan view of the basic triangular planar element of the invention.

The interior arcs ab, ac and bc should be scored with a dull pointed tool to facilitate folding of the three-lobed disc A along these curves. The entire three-lobed disc A may be cut along the exterior arcs ab, ac and bc to form the first basic element of the kits of this invention as shown in FIG. 2—three-lobed ("triangular") disc A bearing only three arcuate scored lines positioned end-to-end to define, with the three arcuate edges of the disc A, three interiorly unscored ("linear") lobes L surrounding an interiorly unscored figure T defined by the interior arcs of the lobes L which will be referred to in this specification as a triangle and a polygon although its equilateral sides are curvilinear. The original equilateral construction triangle abc of FIG. 1 is of no further use and is, therefore, absent.

Figure 3:
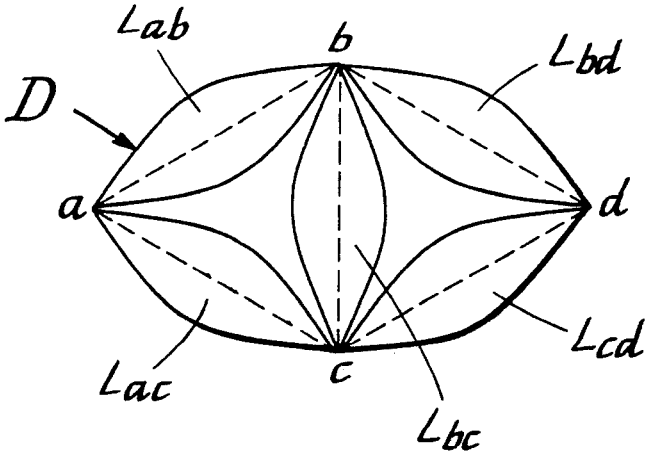
FIG. 3 is a plan view of a flat sheet showing how to construct the basic rhombic element of the invention and the two triangle planar component shown in FIG. 5.
Figure 4:
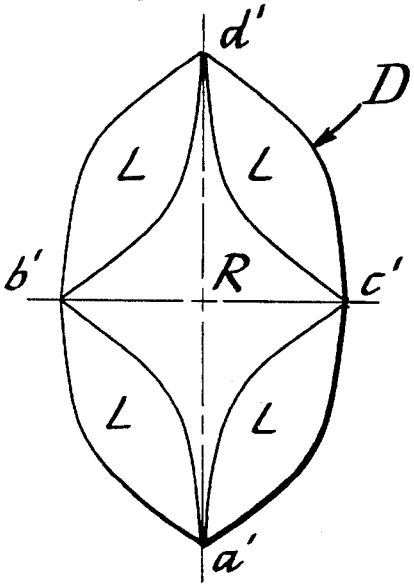
FIG. 4 is a plan view of the basic rhombic planar element of the invention.

Referring next to FIG. 3, two equilateral triangles abc and bcd congruent with the equilateral triangle abc used in the construction of the three-lobed disc A are placed side-to-side along their respective sides bc to form an equilateral rhombus abdc. Following the procedure set forth above with respect to the equilateral triangle abc of FIG. 1, a four-lobed disc D may be constructed. Scoring the interior arcs ab, bd, ac and cd and cutting out the four-lobed "rhombic"disc along the exterior arcs ab, bd, ac and cd forms the second basic element of the kits of this invention as shown in FIG. 4—a four-lobed ("rhombic") disc D provided with four scored ("linear") lobes L and a central figure R defined by the interior arcs of the lobes L which will be referred to herein as a rhombus or diamond and a polygon although its equilateral sides are curvilinear.

It should be noted that, in addition to being foldable along its scored interior arcs, the four-lobed rhombic disc D is bendable into a curvilinear non-planar shape about either of its diagonal axes a'd'and b'c'.

Figure 5:
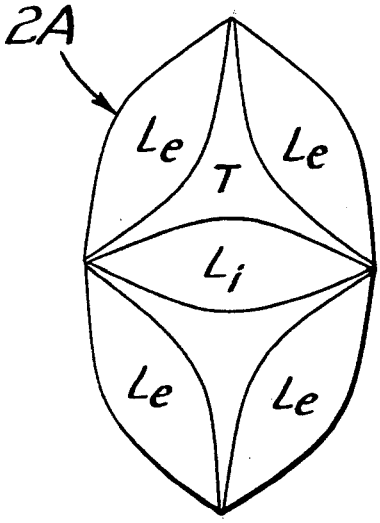
FIG. 5 is a plan view of a two triangle planar component of the invention.

Referring again to FIG. 3, additional arcs bc may be added and scored on either side of the common side bc of the two equilateral triangles abc and bcd to form a linear lobe $L_{bc}$ congruent with the lobes $L_{ab}$, $L_{ac}$, $L_{bd}$ and $L_{cd}$. The resultant planar component part 2A is shown in FIG. 5 and is made up of two equilateral triangles T, four exterior lobes $L_e$ and one interior lobe $L_i$, all lobes being congruent. It will be observed that this same component 2A could have been constructed by superimposing and glueing together one lobe each of two-three-lobed discs A to form the interior lobe $L_i$.

Figure 6:
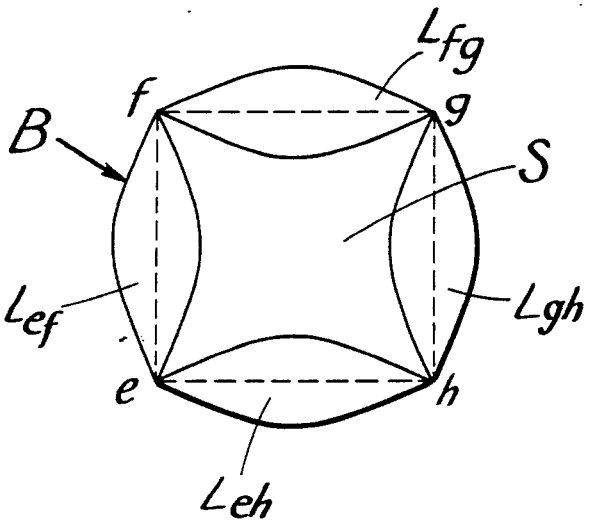
FIG. 6 is a plan view of a flat sheet showing how to construct the basic square element of the invention.
Figure 7:
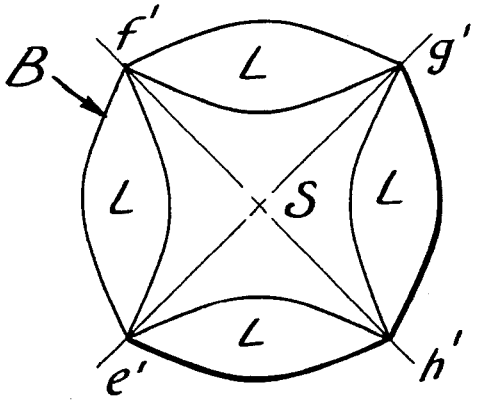
FIG. 7 is a plan view of the basic square planar element of the invention.

Considering now the square efgh shown by dotted lines in FIG. 6, the sides ef, fg, gh and eh of the square are, in the kits of the preferred embodiment of the invention, of equal length to the sides of equilateral triangle abc used in the construction of the three-lobed disc A. Accordingly, lobes $L_{ef}$, $L_{fg}$, $L_{gh}$ and $L_{eh}$, congruent with each other and with the lobes L of the three lobed disc A, may be constructed about the sides ef, fg, gh and eh of the square efgh to define the four-lobed "square" disc B containing a closed interior figure S having identical symmetrically curved sides ef, fg, gh, and eh. The resultant four-lobed disc B scored along the interior arcs of its lobes L and cut out along the exterior arcs of its lobes L forms the third basic planar element of the kits of this invention as shown in FIG. 7. The interior four-sided figure S will be referred to herein as a square and a polygon although its equilateral sides are curvilinear.

It will be noted that, like the four-lobed rhombic disc D, the four-lobed square disc B is bendable into a curvilinear non-planar shape about either of its diagonal axes e'g' and f'h' in addition to being foldable along its scored interior arcs.

Figure 8:
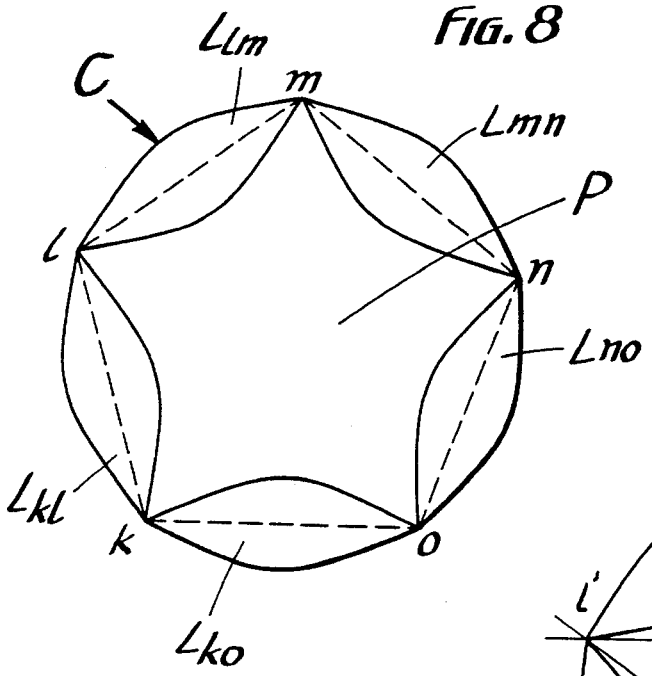
FIG. 8 is a plan view of a flat sheet showing how to construct the basic pentagonal element of the invention.
Figure 9:
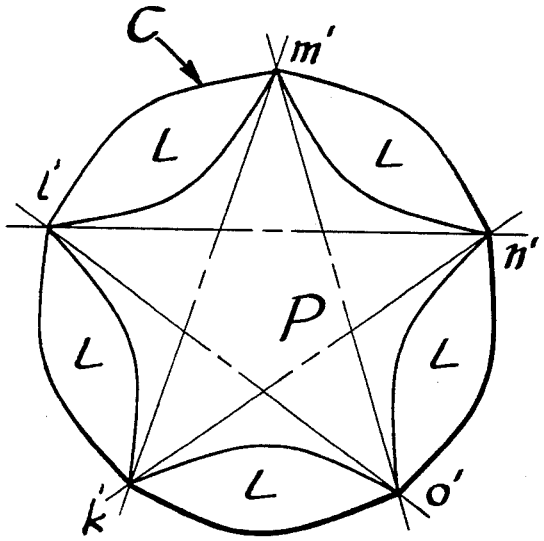
FIG. 9 is a plan view of the basic pentagonal planar element of the invention.

FIG. 8 depicts in dotted lines an equilateral pentagon klmno having, in the preferred embodiment, sides kl, lm, mn, no and ko equal in length to the sides of the equilateral triangle abc utilized in the construction of the three-lobed disc A. Accordingly, lobes $L_{kl}$, $L_{lm}$, $L_{mn}$, $L_{no}$ and $L_{ko}$, congruent with each other and with the lobes L of the three-lobed disc A, may be constructed about the sides kl, lm, mn, no and ko of the equilateral pentagon klmno to define the five-lobed "pentagonal" disc C containing a closed interior figure P having identical symmetrically curvilinear sides kl, lm, mn, no and ko. The resultant five-lobed disc C scored along the interior arcs of its lobes L and cut out along the exterior arcs of its lobes L forms the fourth basic planar element of the kits of this invention as shown in FIG. 9. The interior five-sided figure P will be referred to herein as a pentagon and a polygon although its equilateral sides are curvilinear.

The five-lobed disc P as shown in FIG. 9 may be bent into a curvilinear non-planar shape about any of its axes k'm', k'n', l'n', l'o' and m'o' or simultaneously about any two adjacent axes, k'm' and k'n' for example, all in addition to its being foldable along its scored interior arcs.

Figure 30:
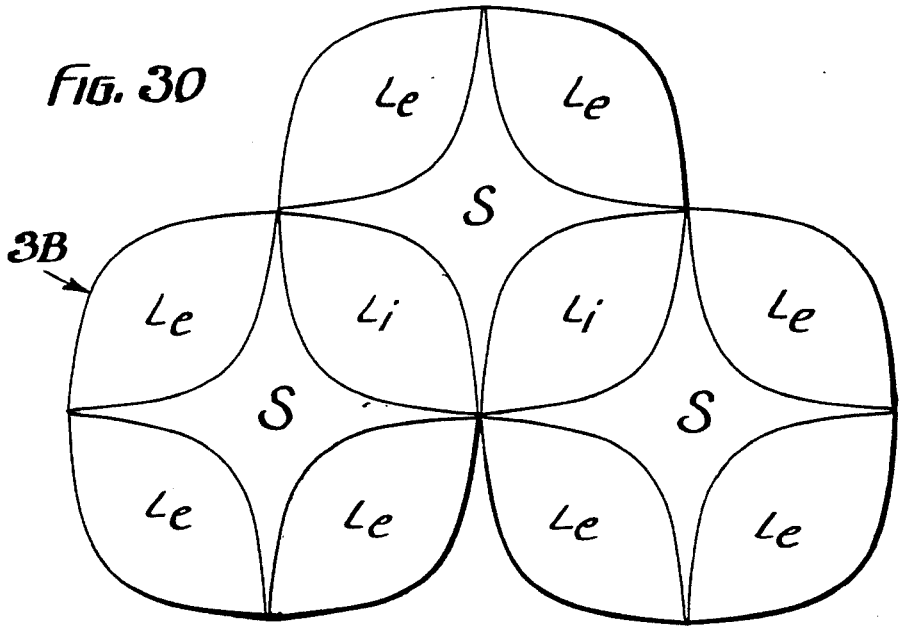
FIG. 30 is a plan view of a three square planar component of the invention.

It should be noted that the congruence of all of the lobes L of the four basic elements A, B, C and D described supra and the basic element E described infra is necessary only to permit assembly of various combinations of these basic elements into more complex planar components and into closed monohedrons and polyhedrons as hereinafter described. On the other hand, if, for example, it were desired to form a planar component 3B, as is shown in FIG. 30, only of four four-lobed discs B by superimposing lobes of the discs much in the manner of the construction of the planar component 2A of FIG. 5, the lobes of the four-lobed discs B could be somewhat more acutely curved without encountering the interior curve intersection problem mentioned in connection with the construction of the three-lobed disc A.

The four basic elements previously described herein and the hexagonal element hereinafter described are all included within the scope of the expression, "component" as used herein since all of the monohedrons and polyhedrons which may be constructed with the kits of this invention may be constructed directly from the basic element components by folding the lobes thereof and superimposing and glueing lobes of a suitable selection of the respective basic elements together. However, it has been found desirable in most cases to create more complex components in planar form prior to the assembly of the polyhedrons of the invention. This is done by eliminating one of each pair of lobes which could otherwise be superimposed and glued in a planar configuration prior to folding the more complex component into all or part of a polyhedron. Such is the case in the planar component 2A shown in FIG. 5 which could be formed by superimposing and glueing one lobe each of two three-lobed discs A of FIG. 2, but is instead constructed directly as a single layer planar component with the interior lobe $L_i$ replacing the otherwise superimposed lobes L of the respective three-lobed discs A.

Figure 10:
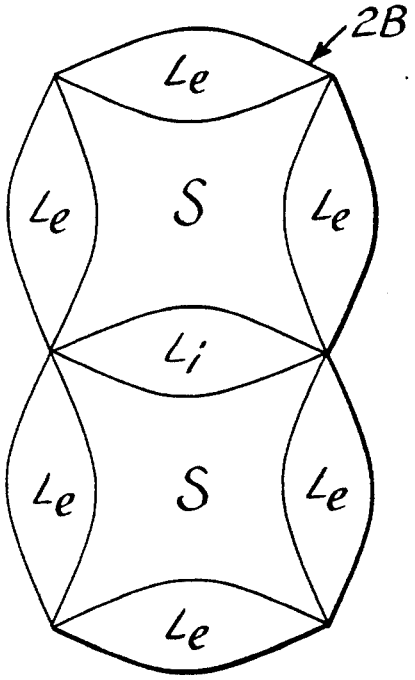
FIG. 10 is a plan view of a two square planar component of the invention.
Figure 11:
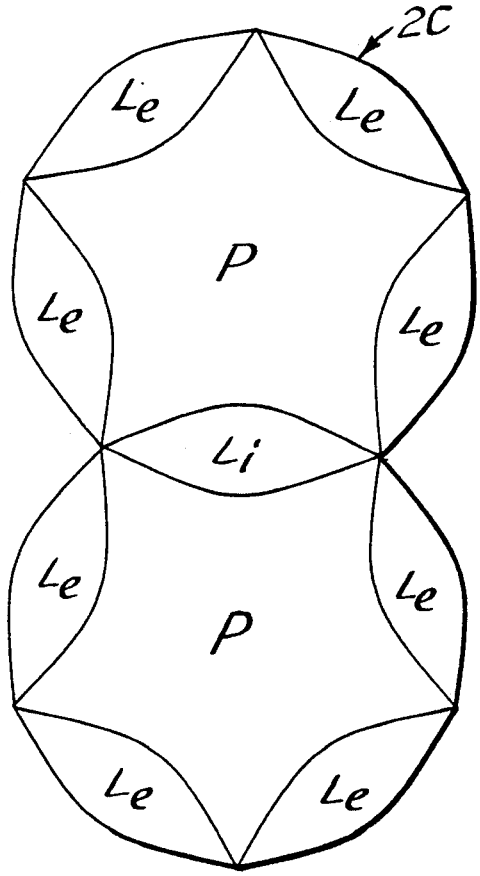
FIG. 11 is a plan view of a two pentagon planar component of the invention.
Figure 12:
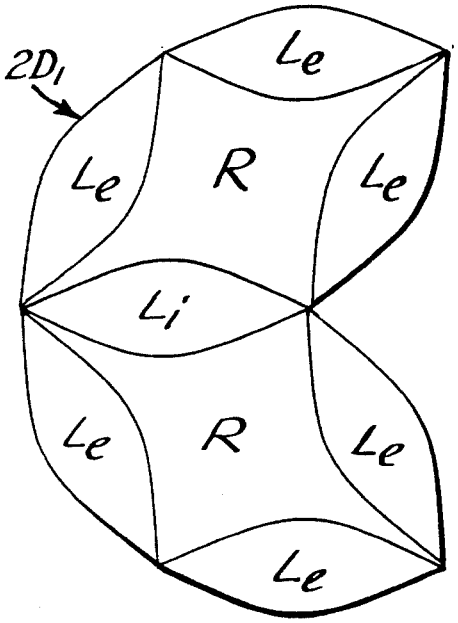
FIG. 12 is a plan view of a two rhombus planar component of the invention.
Figure 13:
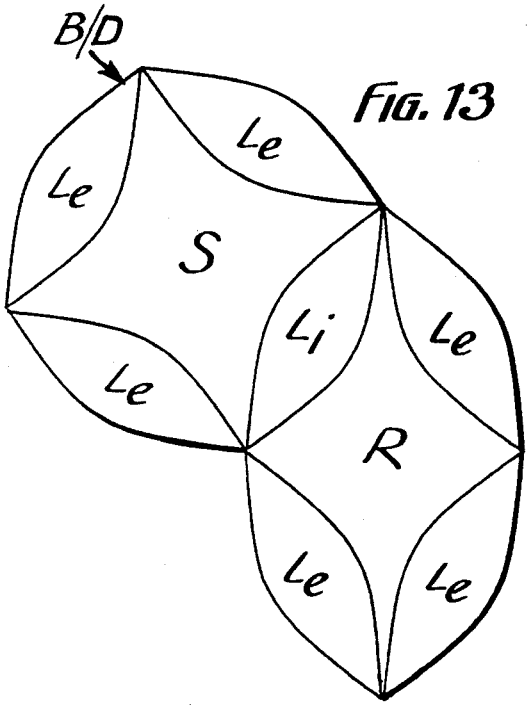
FIG. 13 is a plan view of a variform two polygon planar component of the invention.

Other planar components suitable for forming bifacial polyhedrons are illustrated in FIGS. 10, 11, and 12 and 13. In FIG. 10, two four-lobed square discs B have been combined into a single planar component 2B having two squares S, six exterior lobes $L_e$ and an interior lobe $L_i$ replacing the otherwise superimposed lobes L of the respective four-lobed discs B. Similarly, in FIG. 11, two five-lobed discs C have been combined into a single planar component 2C having two pentagons P, eight exterior lobes $L_e$ and one interior lobe $L_i$ replacing the otherwise superimposed lobes L of the respective five-lobed discs C. In FIG. 12, two four-lobed rhombic discs D have been combined into a unitary planar component 2D having two rhombuses R, six exterior lobes $L_e$ and one interior lobe $L_i$ replacing the otherwise superimposed lobes L of the respective four-lobed discs D. In FIG. 13, a square four-lobed disc B and a rhombic four-lobed disc D have been combined into a unitary planar component B/D having a square S, a rhombus R, six exterior lobes $L_e$ and an interior lobe $L_i$ replacing the otherwise superimposed lobes L of the four-lobed disc B and the four-lobed disc D.

Figure 14:
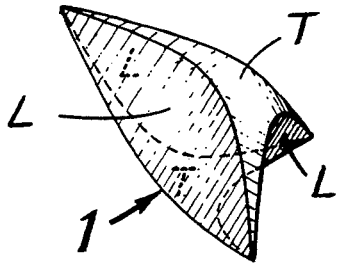
FIG. 14 is a perspective view of a triangular bifacial polyhedron of the invention.

Considering next the formation of monohedrons and polyhedrons or "shells" from the planar components of the invention, bifacial shells can be formed from each of the components 2A, 2B, 2C, 2D and B/D shown in FIGS. 5, 10, 11, 12 and 13 respectively. To do this, each of the exterior lobes $L_e$ should first be prefolded from the plane, of FIG. 5 for example, along their arcuate interior edges to form an angle of about 90° with the two triangles T and interior lobe $L_i$ constituting the remainder of the component 2A. Next, still considering the 2A (two triangle) component of FIG. 5, the two triangles T should each be prefolded along their respective arcuate edges in common with the arcuate edges of the interior lobe $L_i$ to an angle of about 90°. Finally the entire component 2A may then be folded along all of its now prefolded interior arcs to a position such that the right-hand (as shown in FIG. 5) lobes $L_e$ will be completely superimposed upon each other and the left hand lobes $L_e$ will likewise be completely superimposed upon each other. The thus superimposed exterior lobes $L_e$ may be glued together in this position to form the triangular bifacial shell 1 illustrated in FIG. 14. It will be observed that each of the lobes $L_e$ and $L_i$ are now exteriorly concave while the triangles T are exteriorly convex.

Figure 15:
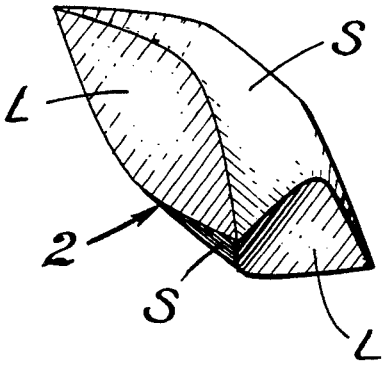
FIG. 15 is a perspective view of a square bifacial polyhedron of the invention.
Figure 16:
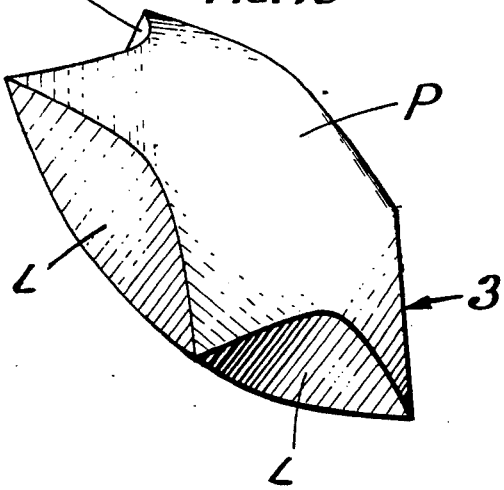
FIG. 16 is a perspective view of a pentagonal bifacial polyhedron of the invention.
Figure 17:
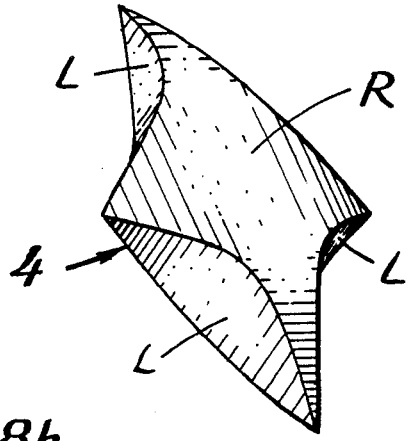
FIG. 17 is a perspective view of a rhombic bifacial polyhedron of the invention.
Figure 18A:
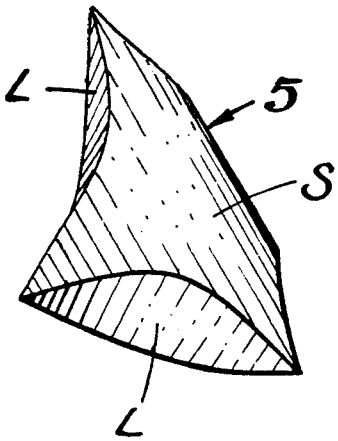
FIGS. 18*a*–18*b* are two different perspective views of a variform polygonal bifacial polyhedron of the invention.
Figure 18B:
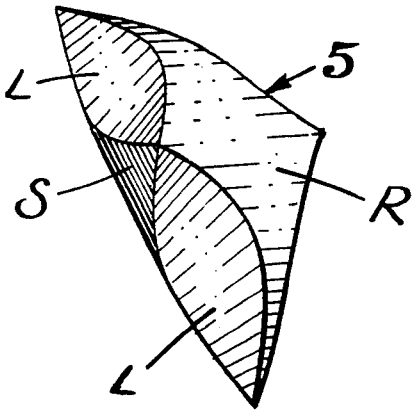

By the same prefolding, final folding and glueing procedure, the two square components 2B of FIG. 10 will form the square bifacial shell 2 illustrated in FIG. 15, the two pentagon component 2C of FIG. 11 will form the pentagonal bifacial shell 3 illustrated in FIG. 16, the two rhombus component 2D of FIG. 12 will form the rhomic bifacial shell 4 illustrated in FIG. 17 and the one square one rhombus component B/D of FIG. 13 will form the bifacial shell 5 illustrated in FIGS. 18*a* and 18*b*, one face S being square and the other R being rhombic. The respective curvatures of the square face L and the rhombic face R automatically adjust themselves to compensate for the differences in length between diagonal of the square S and the longer of the two diagonals of the rhombus R. A one triangle one pentagon component A/C (not illustrated) constructed from one three-lobed disc A and one five-lobed disc C may also be formed into an arrowhead-shaped object which might be referred to as a bifacial shell (also not illustrated).

Figure 19:
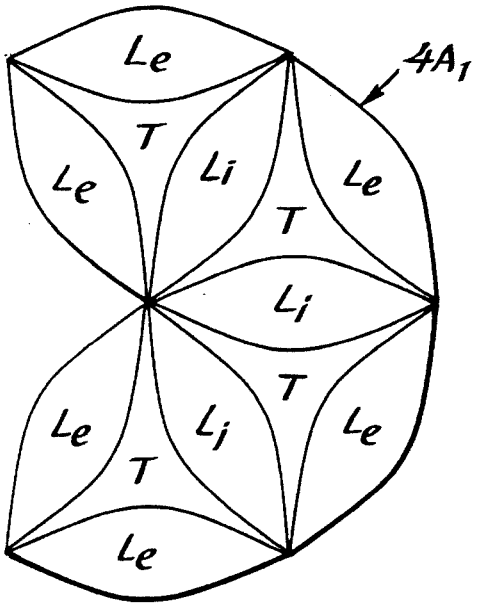
FIGS. 19–20 are plan views of two different four triangle planar components of the invention.
Figure 20:
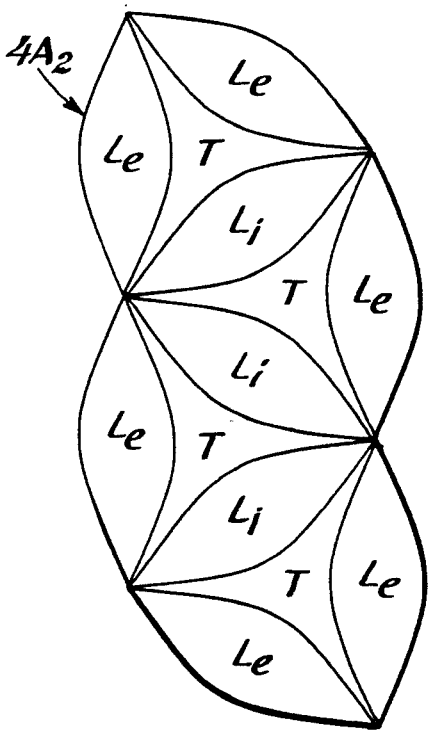
Figure 21A:
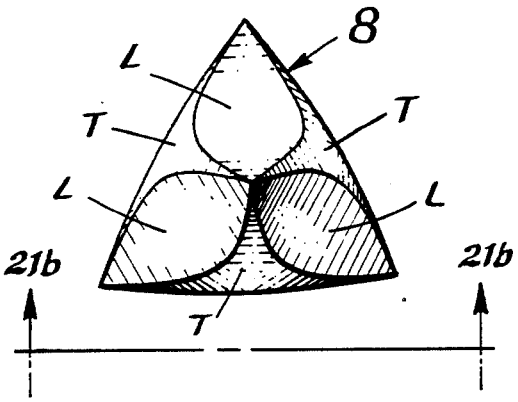
FIGS. 21*a*–21*d* are four different views of a tetrahedron formed from the planar component of FIG. 20.
Figure 21B:
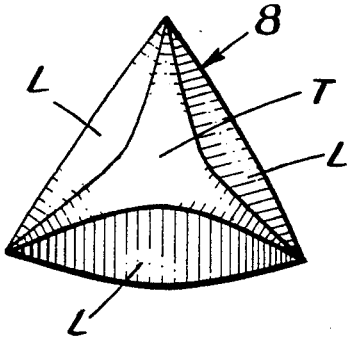
Figure 21C:
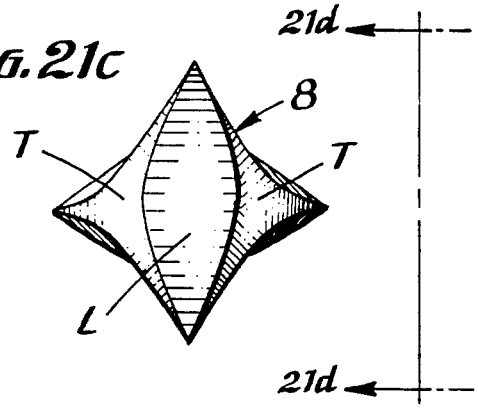
Figure 21D:
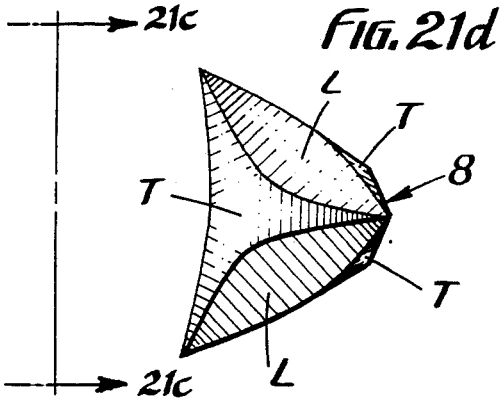

FIGS. 19 and 20 illustrate two different planar components $4A_1$ and $4A_2$ each having four triangles T, three interior lobes $L_i$ and six exterior lobes $L_e$. These planar configurations may each be formed from four three-lobed discs A, from two 2A components or, as is here shown, from a unitary planar component 4A.

Figure 23:
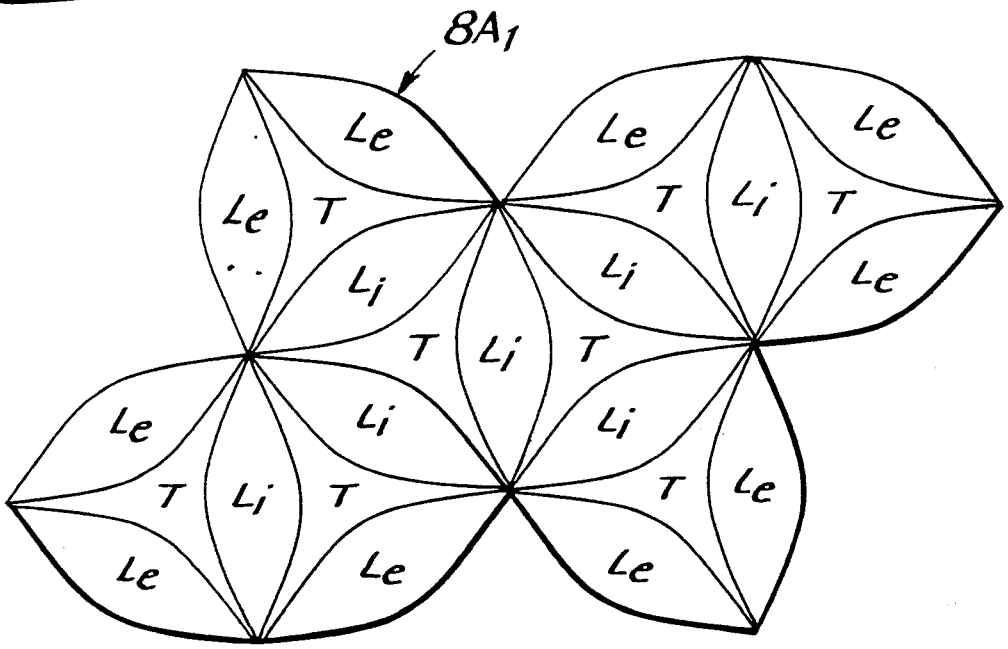
FIG. 23 is a plan view of an eight triangle component of the invention.
Figure 24A:
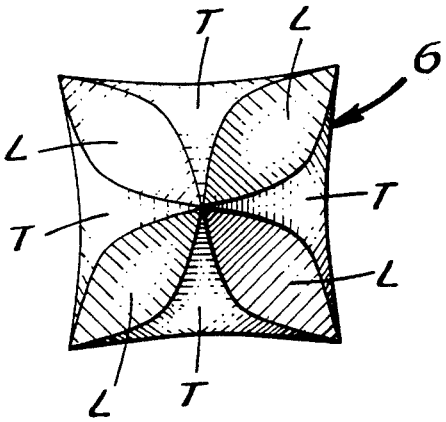
FIGS. 24*a*–24*b* are two different views of an octahedron formed from the planar component of FIG. 23 of the invention.
Figure 24B:
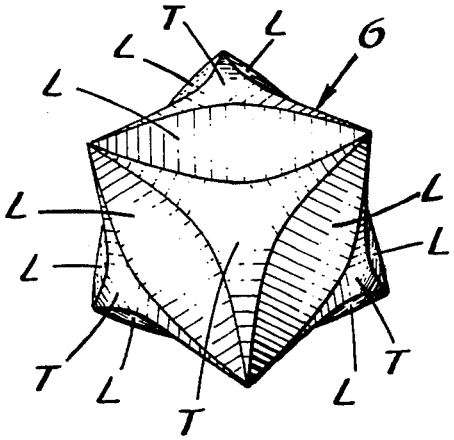

The only closed shell into which the component $4A_1$ may be formed is a rhombic bifacial shell 4 such as that shown in FIG. 17. In this respect components $4A_1$ and 2D are, therefore, interchangeable. Alternatively, by superimposing and glueing together its two left-hand (as shown in FIG. 19) exterior lobes $L_e$, the component $4A_1$ will form an open four-sided three-dimensional object which may be mated with another such object to form a closed octahedron 6 such as that illustrated in FIGS. 24*a* and 24*b*. In another approach, two $4A_1$ components may be combined to form the planar component $8A_1$ illustrated in FIG. 23 which, in turn, may be prefolded, folded and glued to form the closed octahedral shell 6 illustrated in FIGS. 24*a* and 24*b*.

The component $4A_2$ may also be formed into a closed bifacial rhombic shell 4. Such a formation is promoted by not prefolding the arcs encompasing the central interior lobe $L_i$. If the area of the central lobe interior $L_i$ are prefolded and those of the two end interior lobes $L_i$ are left unprefolded, the component $4A_2$ becomes essentially a $2D_2$ component which may be formed into the rhombic bifacial shell 7 illustrated in FIGS. 25*a* and 25*b*.

Fully prefolded, folded and glued the component $4A_2$ will form the closed tetrahedral shell 8 illustrated in FIGS. 21*a*, 21*b*, 21*c* and 21*d*. This shell 8 is referred to as a tetrahedron (and a polyhedron) even though all of its surfaces are curvilinear. The expression "tetrahedron" is derived from the four convex triangular surfaces T, the lobe surfaces L being ignored for purposes of polyhedron nomenclature. Lobes L are ignored in the nomenclature for all closed shells herein.

Figure 22:
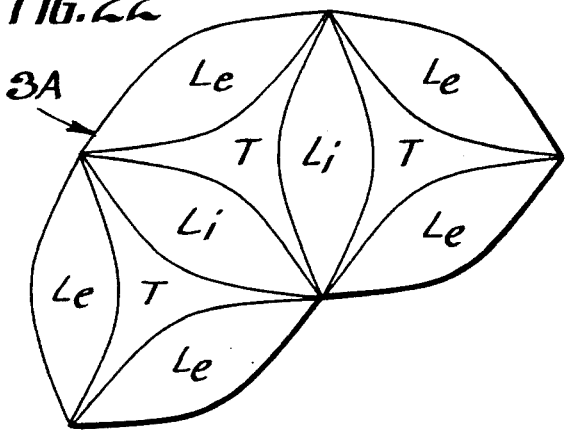
FIG. 22 is a plan view of a three triangle component of the invention.
Figure 34A:
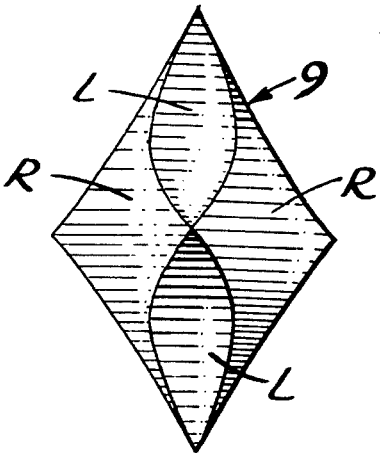
FIGS. 34*a* and 34*b* are two different views of a trifacial polyhedron formed from either of the planar components of FIGS. 32 and 33 of the invention.
Figure 34B:
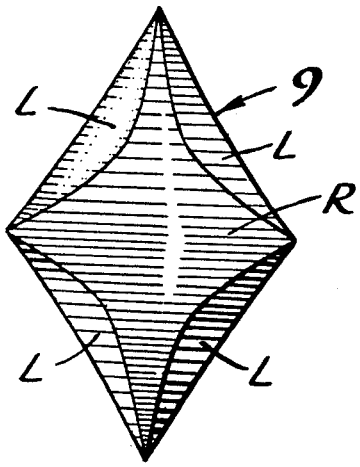

FIG. 22 illustrates a component 3A having three triangles, two interior lobes $L_i$ and five exterior lobes $L_e$. This component 3A cannot be closed to form a complete shell although it can be partially closed to form a three-sided open-ended three-dimensional device which, when mated with another such device, will form a trihedral shell 9 such as is illustrated in FIGS. 34*a* and 34*b*. Alternatively, the 3A component can be mated with a three-lobed disc A to form either a $4A_1$ component or a $4A_2$ component both of which may form a closed polyhedral shell. In general, planar components having an odd number of exterior lobes $L_e$ will not alone fold or bend (or both) into closed shells. Components having even numbers of exterior lobes $L_e$ may, if they are otherwise suitable, be folded or bent or both into closed shells.

Figure 27:
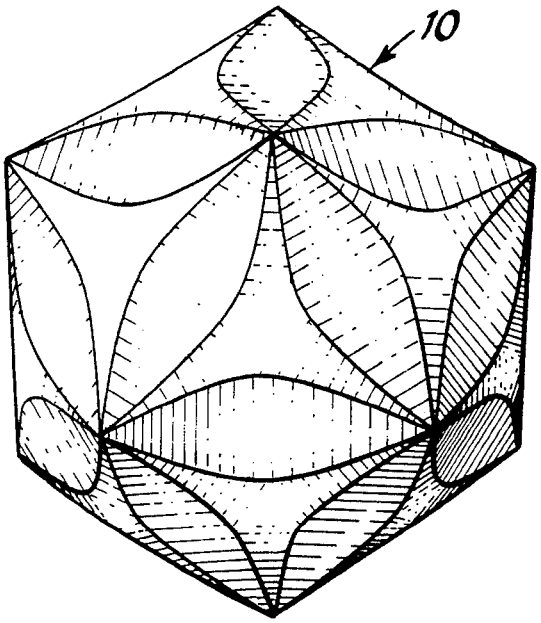
FIG. 27 is a perspective view of an icosahedron formed from the planar component of FIG. 26.

FIG. 26, for example, depicts a $20A_1$ component having 20 triangles T arranged into a $4\times5$ configuration, 22 exterior lobes $L_e$ and 19 interior lobes $L_i$ which may be prefolded, folded and glued into the closed icosahedral shell 10 depicted in FIG. 27.

Figure 28:
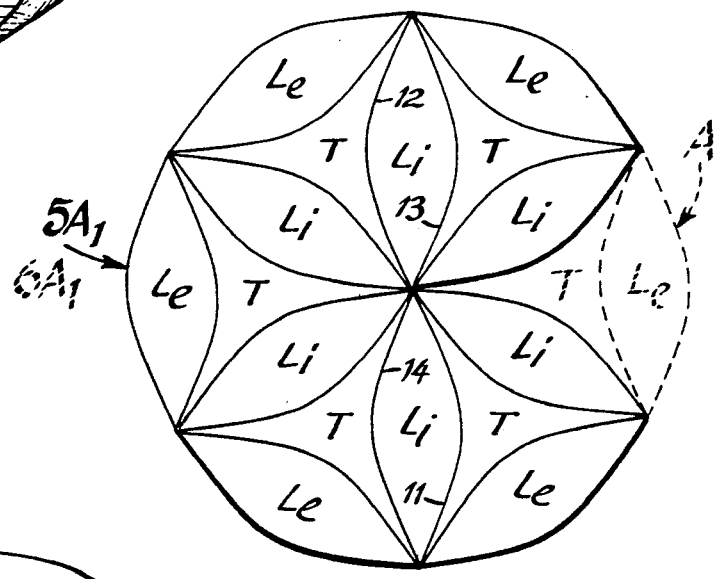
FIG. 28 is a plan view of a five triangle planar component of the invention showing its conversion into a six triangle component of the invention.

The $5A_1$ component shown in solid lines in FIG. 28, which has five triangles, seven exterior lobes $L_e$ and four interior lobes $L_i$, cannot be folded or bent into a closed shell. However, combined with another $5A_1$ component it may be used to form a closed decahedral shell (not illustrated).

If an additional three-lobed disc A is added to the $5A_1$ component in the position shown in dotted lines in FIG. 28 and is glued in place thereby converting the $5A_1$ component shown in FIG. 28 to a $6A_1$ component and converting the two exterior lobes $L_e$ of the $5A_1$ component upon which two lobes of the added three-lobed disc A are superimposed and glued to interior lobes $L_i$, the resultant $6A_1$ component, having six triangles T, six exterior lobes $L_e$ and six interior lobes $L_i$, is readily perceived to be hexagonal in shape. This $6A_1$ planar component which has an equal number of exterior lobes $L_e$ may be folded upon itself following the arc 11, 12, 13 and 14 of two opposed interior lobes $L_i$ to form a closed pentagonal bifacial polyhedron different in shape from the pentagonal bifacial polyhedron 3 shown in FIG. 16. Each face of the pentagonal bifacial polyhedron so formed is a smoothly curved surface made up of three triangles T and two interior lobes $L_i$ not folded with respect to each other.

Figure 29:
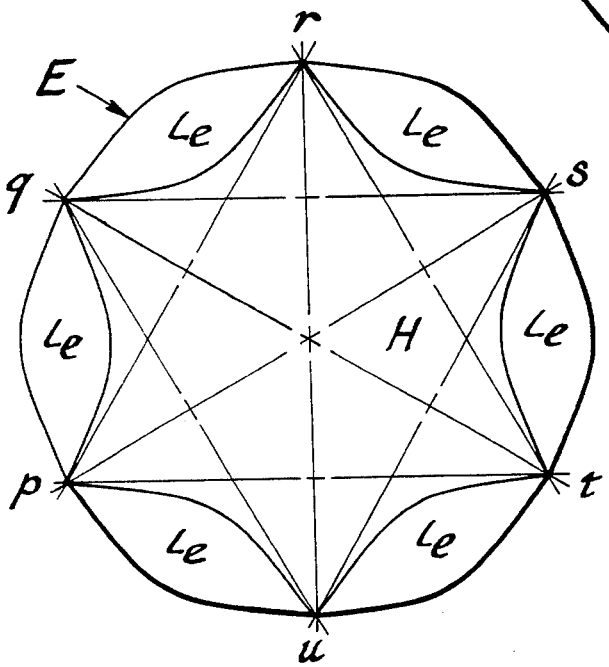
FIG. 29 is a plan view of the basic hexagonal planar element of the invention.

Alternatively, the interior lobes of the component $6A_1$ may be left unscored and, therefore, omitted. The resultant component, shown in FIG. 29, thereby becomes a fifth potential basic element, a six-lobed disc E having a central hexagon H and six exterior lobes $L_e$. As is the case with the other previously mentioned basic elements A, B, C, and D, the six-lobed disc E is not foldable except at the interior arcs of its exterior lobes $L_e$ because it lacks scored interior lobes $L_i$. It is, however, bendable about one, two or three of its several axes pr, ps, pt, qs, qt, qu, rt, ru, and su.

Although it is somewhat oversized as compared to the three-lobed disc A, the six-lobed disc E may be combined with other elements or components of the kits of this invention to form a variety of closed polyhedral shells. Larger discs (e.g., seven-lobed, eight-lobed, nine-lobed, etc.) present problems if one were to incorporate them into kits made up of components founded upon the basic elements A, B, C, D and E. In addition to being relatively oversized such elements as eight-lobed discs and ten-lobed discs are really more nearly circular versions of four-lobed discs B and five-lobed discs C. Such larger discs as seven-lobed discs and eleven-lobed discs, for example, additionally have an odd number of lobes and are not multiples (in terms of the number of lobes) of any smaller discs and, therefore, tend to eliminate or limit potential combinations into desirable closed polyhedral shells. Carrying the concept herein set forth to absurdity, it is theoretically possible to form a closed thousand-lobed bifacial polyhedron from two thousand-lobed discs, but the faces would no doubt collapse against each other and the object would resemble nothing more than a very large circle with knurled edges. Accordingly, it is thought to be desirable to limit the kits of this invention to components founded upon three, four and five or, at most six-lobed discs.

Figure 31A:
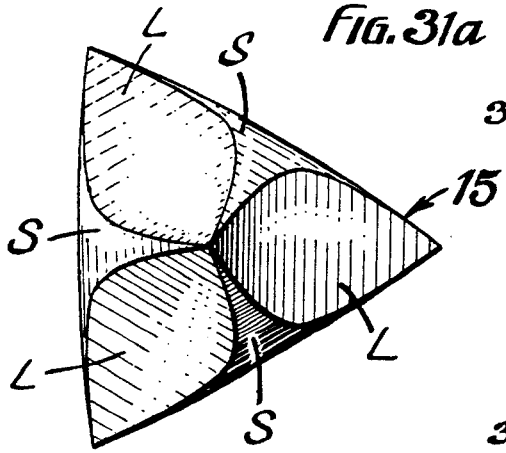
FIGS. 31*a*–31*b* are two different views of a trifacial polyhedron formed from the planar component of FIG. 30 of the invention.
Figure 31A:
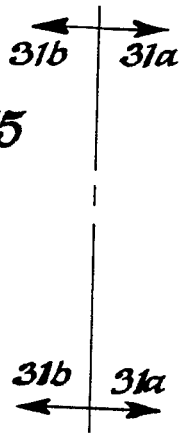
Figure 31B:
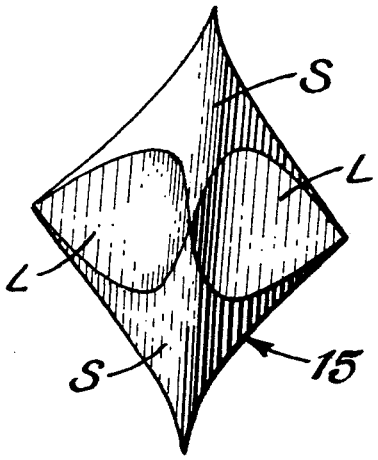

FIG. 30 depicts a 3B component comprised of three squares S and having lobes $L_e$ and $L_i$ with greater width/length ratios than the lobes of the B elements compatible with the three-lobed discs of the kits of the invention. Even lacking such compatibility, components such as this 3B component may be folded or combined with other components founded upon compatible four-lobed discs and thereafter folded to form attractive polyhedrons of a somewhat different appearance. FIGS. 31*a* and 31*b* show two views of a trifacial polyhedron 15 formed by folding and glueing the planar component 3B of FIG. 30.

Figure 32:
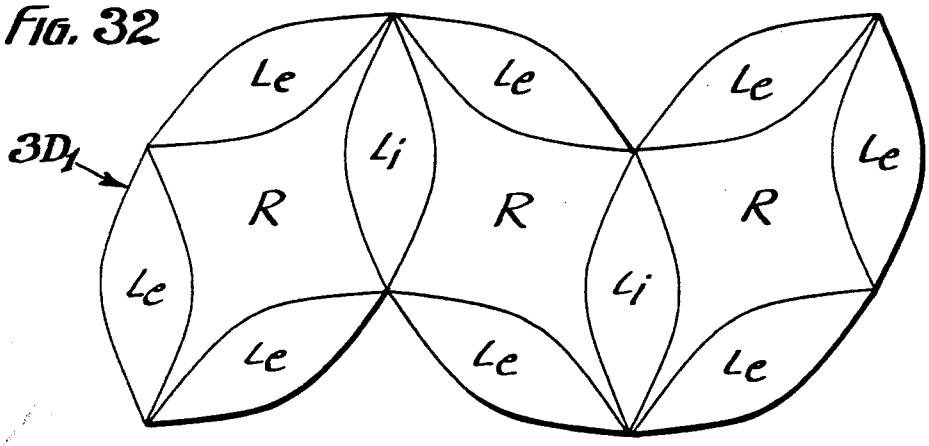
FIGS. 32 and 33 are plan views of two different three rhombus planar components of the invention.
Figure 33:
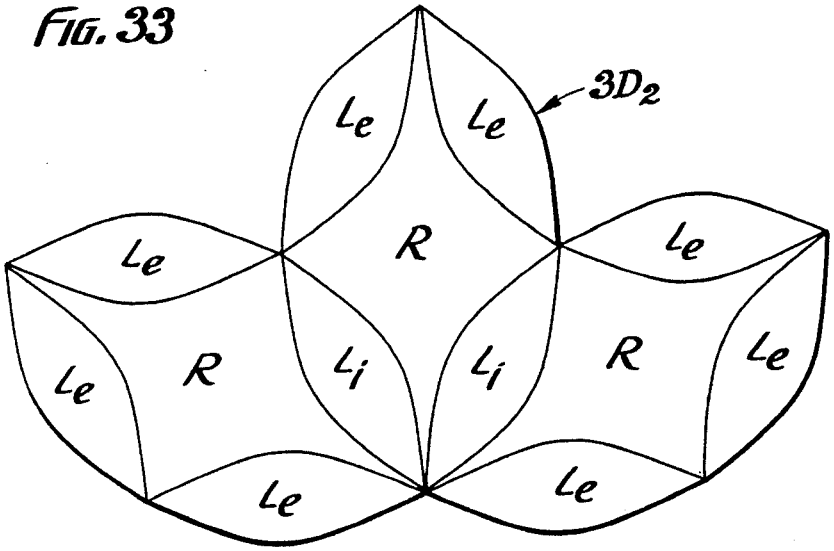

Returning now to polygonal components having lobes L compatible with the lobes L of the three-lobed discs A of the preferred embodiment of the invention, FIGS. 32 and 33 depict two components $3D_1$ and $3D_2$ each having three rhombuses R, eight exterior lobes $L_e$ and two interior lobes $L_i$. Either component $3D_1$ or $3D_2$ may be folded into the closed trifacial polyhedron 9 illustrated in FIGS. 34*a* and 34*b*.

Figure 35:
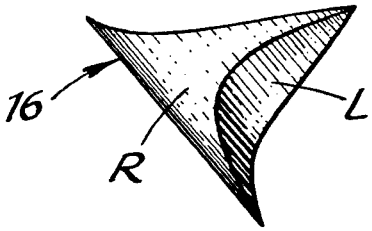
FIG. 35 is a perspective view of a monohedron formed from the planar element of FIG. 4 of the invention.

Basic elements having an even number of exterior lobes may be bent into monofacial three-dimensional objects, monohedrons. This is true of the four-lobed discs B and D as well as the six-lobed disc E. FIG. 35 illustrates a four-lobed rhombic disc D bent into such a monohedron 16 having, arguably, a single rhombic face R and two lobes L.

The varieties of closed polyhedral shells which may be constructed from the kits of the invention are too numerous to describe each of them individually herein. Consequently, only a few more polyhedral shells illustrative of the possibilities of the invention will be discussed.

Figure 36:
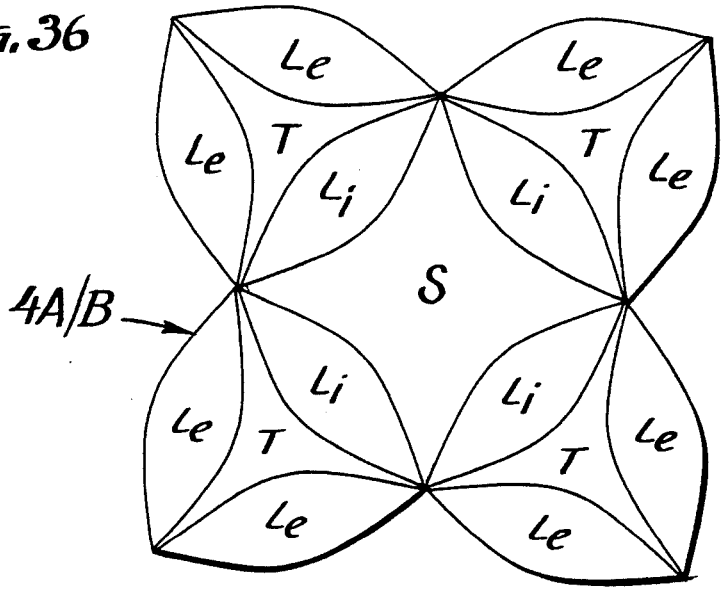
FIG. 36 is a plan view of a one square four triangle component of the invention.
Figure 37A:
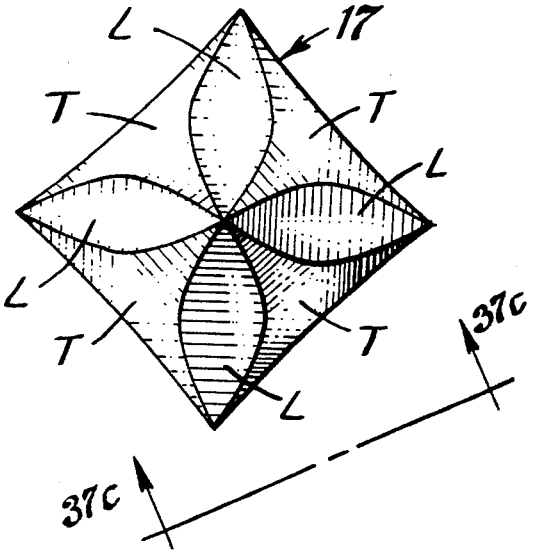
FIGS. 37*a*, 37*b* and 37*c* are three different views of a pentahedron formed from the planar component of FIG. 36 of the invention.
Figure 37B:
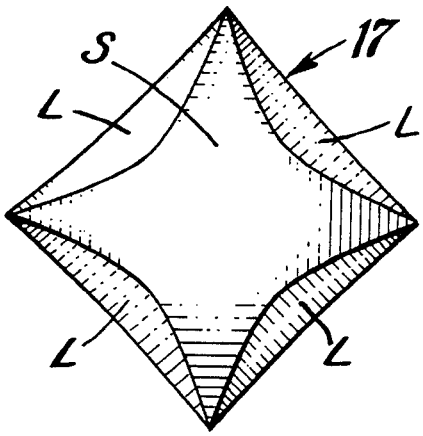
Figure 37C:
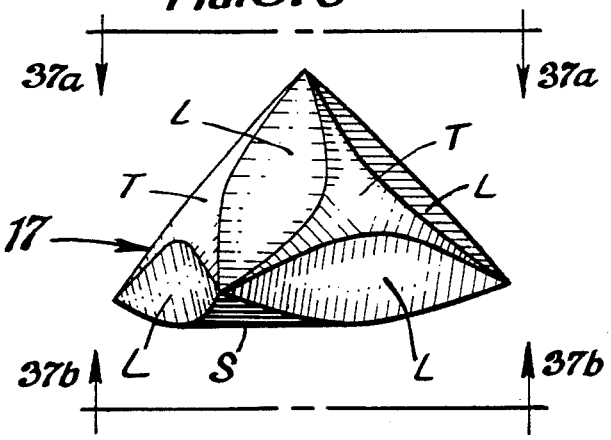

FIG. 36 depicts a component 4A/B having one square S, four triangles T, eight exterior lobes $L_e$ and four interior lobes $L_i$. Folded and glued, this component 4A/B forms the closed pentahedron 17 illustrated in FIGS. 37*a*, 37*b* and 37*c* much in the form of the square-based Egyptian pyramids.

Figure 38:
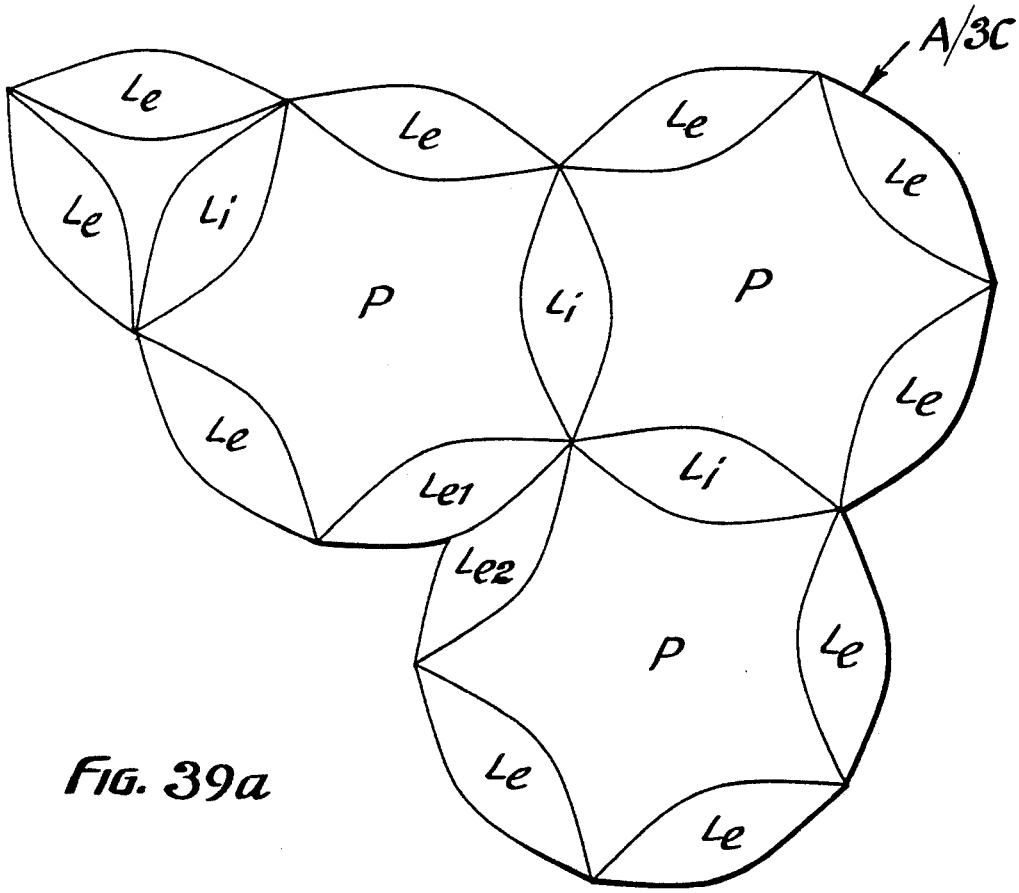
FIG. 38 is a plan view of a one triangle three pentagon component of the invention.
Figure 39A:
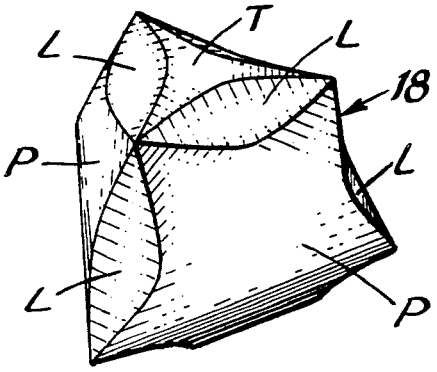
FIGS. 39*a* and 39*b* are two different views of a tetrahedron formed from the planar component of FIG. 38.
Figure 39B:
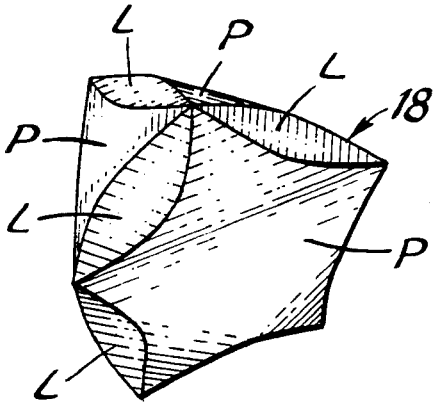

FIG. 38 illustrates a component A/3C having 1 triangle T, three pentagons P, twelve exterior lobes $L_e$ and three interior lobes $L_i$. Because the exterior arcs of the exterior lobes $L_{e1}$ and $L_{e2}$ intersect, $L_{e1}$ is cut out along its entire exterior arc thereby somewhat trimming exterior lobe $L_{e2}$. During assembly of the component A/3C exterior lobe $L_{e1}$ will be superimposed on the outside face of exterior lobe $L_{e2}$ for the sake of appearance. Folded and glued, the planar component A/3C forms the closed somewhat bulbous tetrahedron 18 illustrated in FIGS. 39*a* and 39*b* having a triangular base T and three pentagonal sides P.

Figure 40:
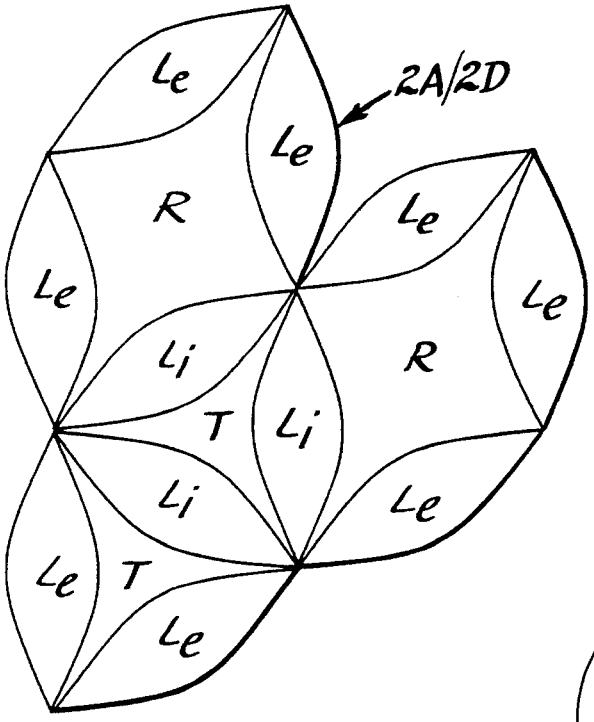
FIG. 40 is a plan view of a two triangle-two rhombus component of the invention.
Figure 41:
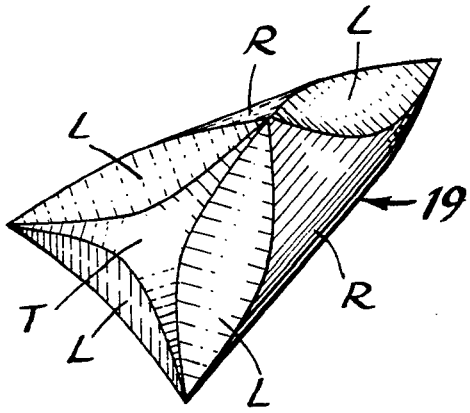
FIG. 41 is a perspective view of a tetrahedron formed from the planar component of FIG. 40.

FIG. 40 depicts a planar component 2A/2D having two rhombuses R, two triangles T, eight exterior lobes $L_e$ and 3 interior lobes $L_i$. Folded and glued this component 2A/2D forms the arrowhead-shaped polyhedron 19 shown in FIG. 41 which has two opposite triangular faces T and two opposite rhombic faces R oriented at 90° from the triangular faces T.

Figure 42:
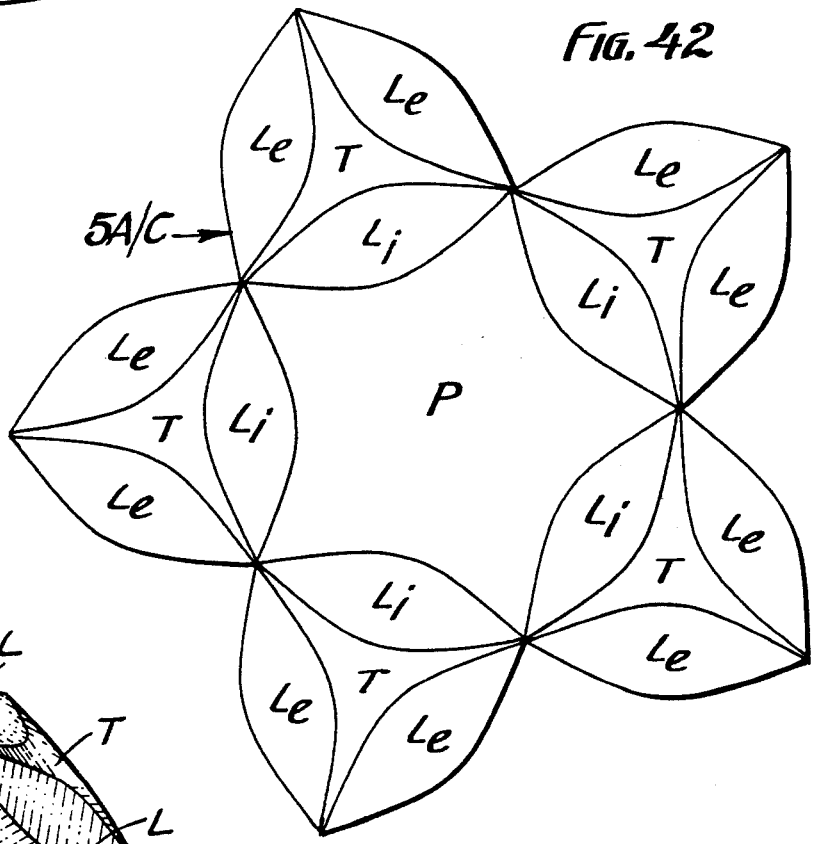
FIG. 42 is a plan view of a five triangle one pentagon component of the invention.
Figure 43:
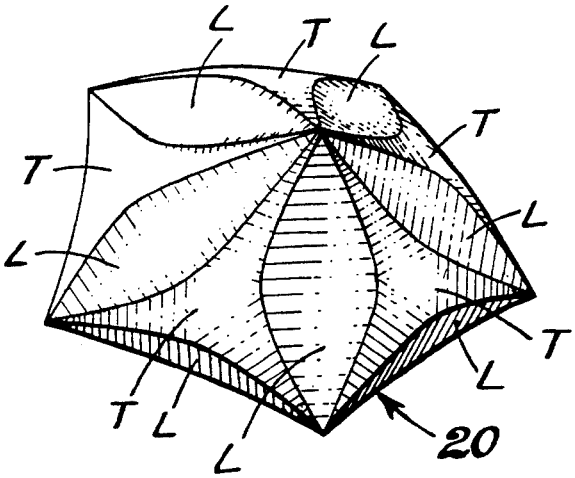
FIG. 43 is a perspective view of the hexahedron formed from the planar component of FIG. 42.

FIG. 43 shows a pentagonally based pyramidal hexahedron 20 which may be formed from the 5A/C planar component shown FIG. 42.

Figure 44:
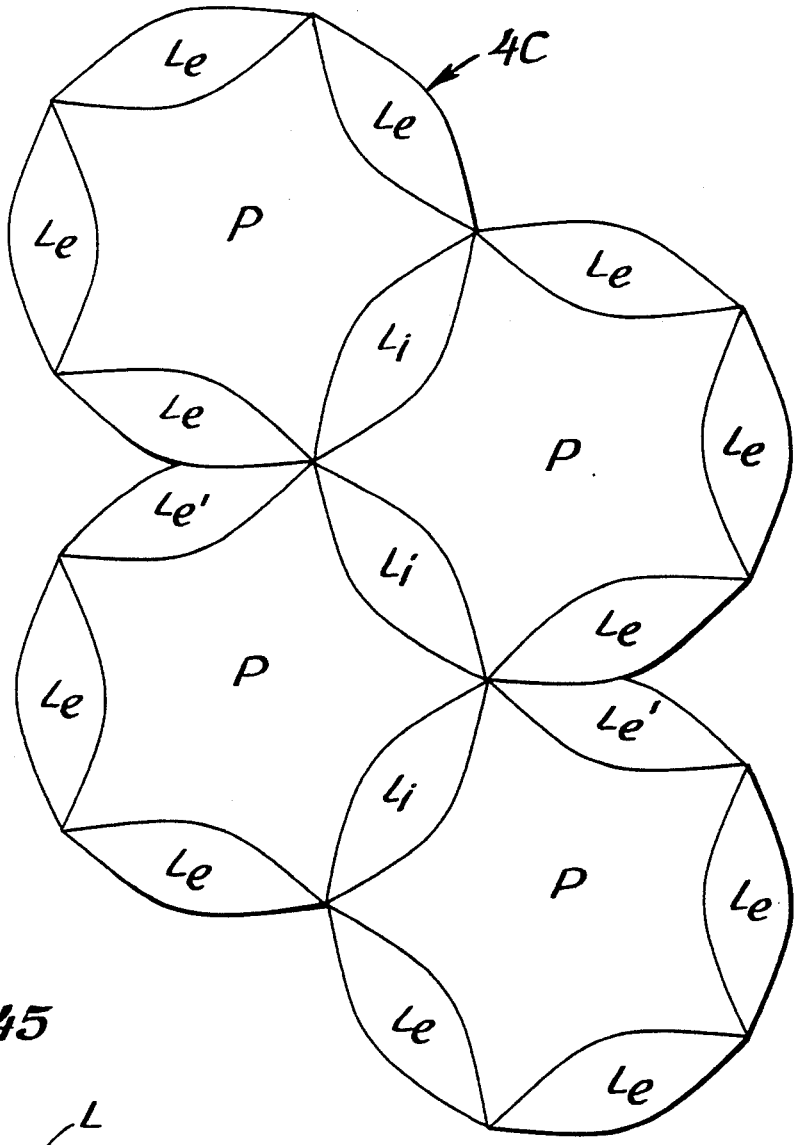
FIG. 44 is a plan view of a four pentagon component of the invention.
Figure 45:
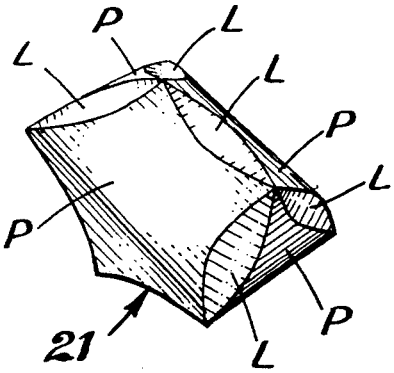
FIG. 45 is a perspective view of the tetrahedron formed from the planar component of FIG. 44.

FIG. 44 shows a planar component 4C having four pentagons P, fourteen exterior lobes $L_e$, and three interior lobes $L_i$. In both instances where the exterior arcs of exterior lobes $L_e$ intersect, one exteriorlobe $L_e$ will be cut along its entire exterior arc and will be superimposed outside the corresponding trimmed exterior arc $L_e$ during folding. Folded and glued, the planar component 4C forms the pentagonally faced tetrahedron 21 illustrated in FIG. 45.

Figure 46:
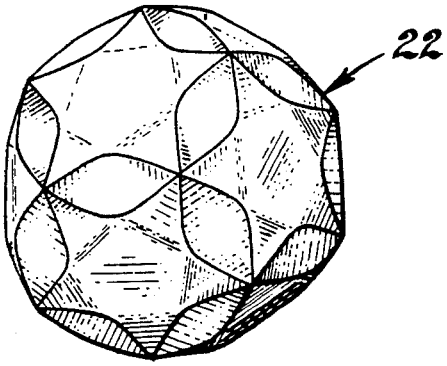
FIG. 46 is a perspective view of a pentagonally faced dodecahedron of the invention.

FIG. 46 depicts a regular dodecahedron 22 having pentagonal faces which may be formed from a 12 C planar component (not illustrated).

Figure 47:
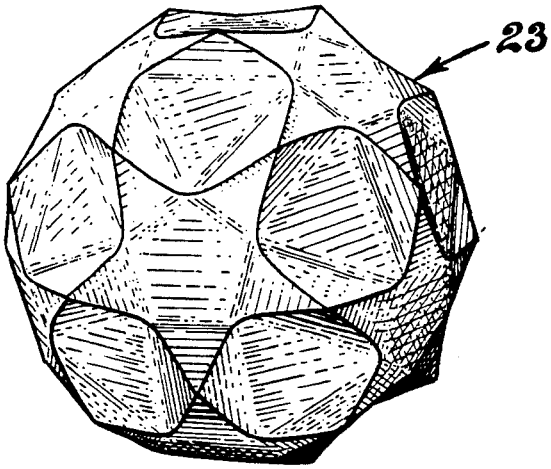
FIG. 47 is a perspective view of a thirty-two faced polyhedron of the invention.

FIG. 47 illustrates a thirty-two faced polyhedron 23 which may be formed from twenty three-lobed discs A and twelve five-lobed discs C, the three-lobed discs A being left unscored and being dimpled by slight finger pressure.

Figure 48:
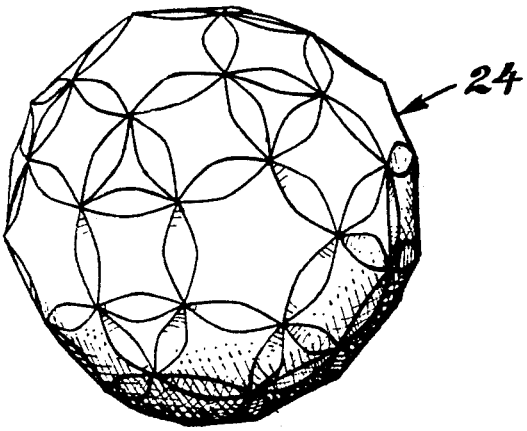
FIG. 48 is a perspective view of a sixty-two faced polyhedron of the invention.

FIG. 48 shows a sixty-two faced polyhedron 24 which may be formed from twenty three-lobed discs A, thirty four-lobed discs B and twelve five-lobed discs C.

Figure 49:
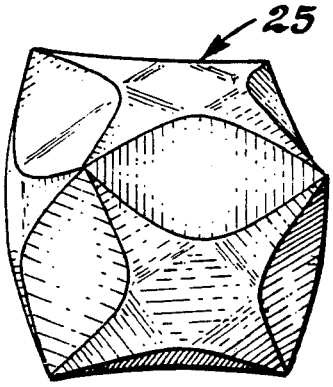
FIG. 49 is a perspective view of a cube of the invention.

FIG. 49 shows a cube 25 formed from six four-lobed discs B or a 6B planar component.

Figure 50:
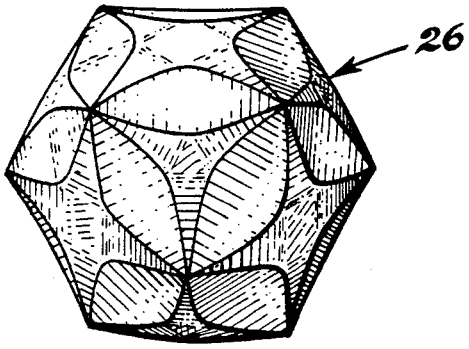
FIGS. 50, 51, 52 and 53 are perspective views of four variant forms of a fourteen-sided polyhedron of the invention.

FIG. 50 shows a truncated (at the corners) cube 26 formed from six four-lobed discs B and eight three-lobed discs A.

Figure 51:
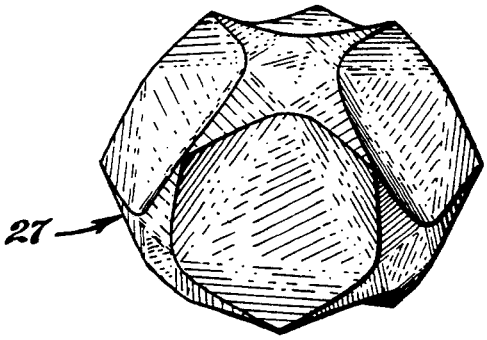

FIG. 51 shows a fourteen-sided polyhedron 27 formed by dimpling all of the three-lobed discs A of the truncated cube 26.

Figure 52:
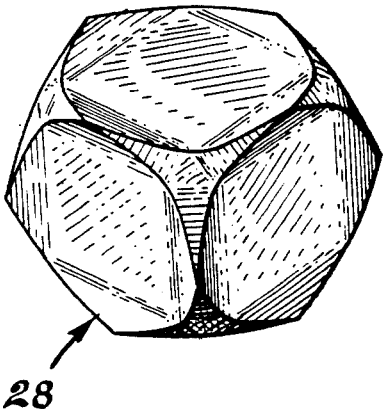

FIG. 52 shows a fourteen-sided polyhedron 28 formed by dimpling all of the four-lobed discs B of the truncated cube 26.

Figure 53:
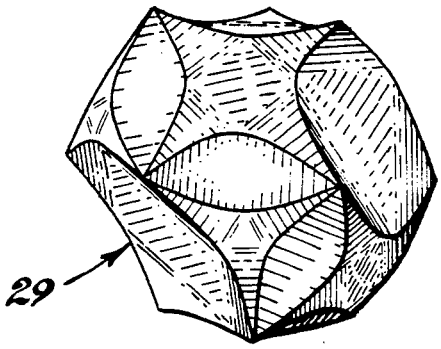

FIG. 53 shows a fourteen-sided polygon 29 formed by dimpling four of the three-lobed discs A and one of the four-lobed discs B of the truncated cube 26.

Various polyhedrons described herein may be glued together point-to-point with other polyhedrons of suitable types, like or unlike, and in suitable numbers to form attractive clusters of polyhedrons.

Figure 54:
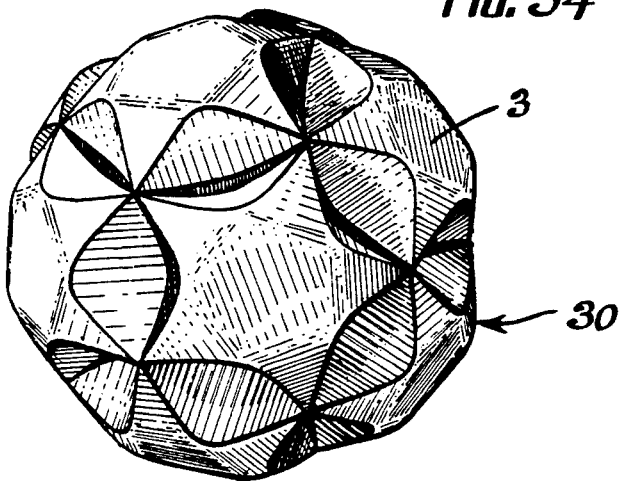
FIG. 54 is a perspective view of a cluster of pentagonal bifacial polyhedrons.
Figure 55:
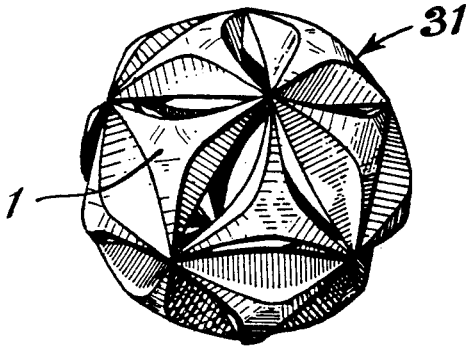
FIG. 55 is a perspective view of a cluster of triangular bifacial polyhedrons.

Considering first clusters of bifacial polyhedrons of like kind, FIG. 54 illustrates a cluster 30 of twelve pentagonal bifacial polyhedrons 3 glued together point-to-point in the form of a ball. FIG. 55 shows a cluster 31 of twenty triangulr bifacial polyhedrons 1 glued together point-to-point in the form of a ball.

Figure 56A:
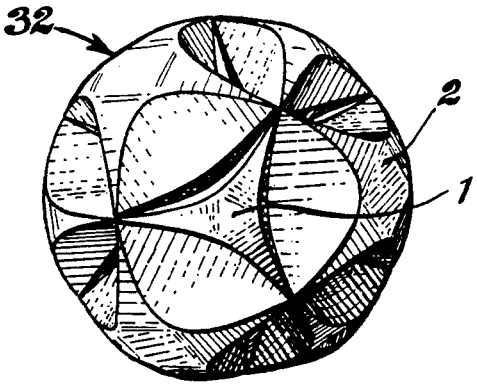
FIGS. 56*a*, 56*b* and 56*c* are three different views of a cluster of triangular and square bifacial polyhedrons.
Figure 56B:
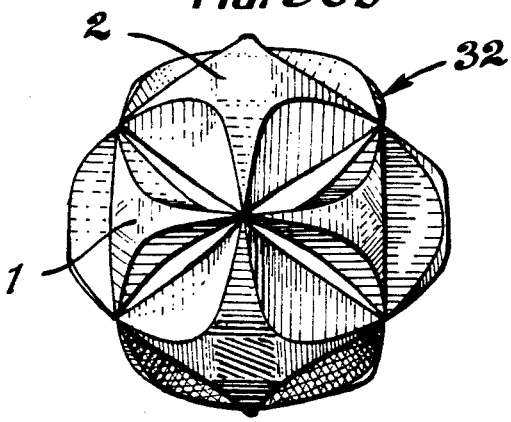
Figure 56C:
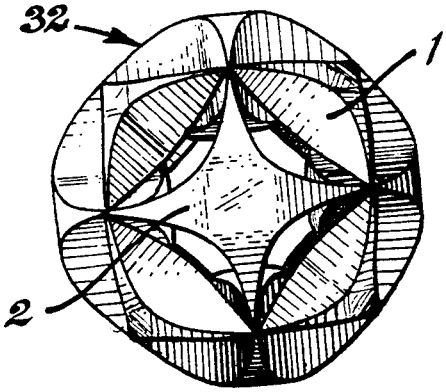
Figure 57:
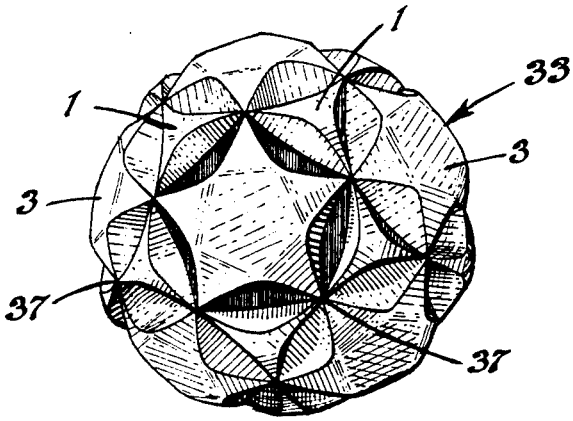
FIG. 57 is a perspective view of a hollow ball-shaped cluster of triangular and pentagonal bifacial polyhedrons.
Figure 58:
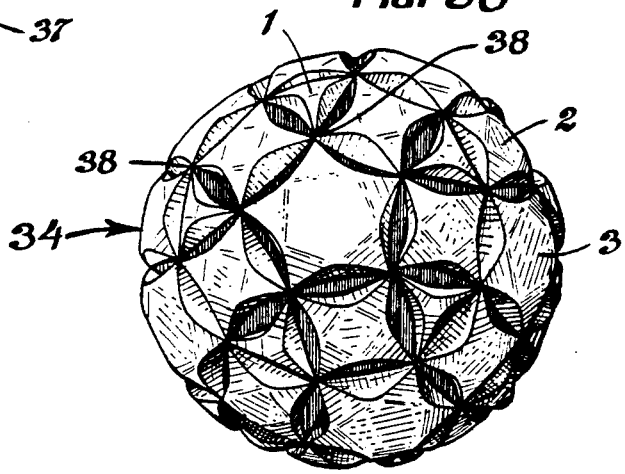
FIG. 58 is a perspective view of a hollow ball-shaped cluster of triangular, square and pentagonal bifacial polyhedrons.

Considering next clusters of bifacial polyhedrons of unlike kinds, FIGS. 56*a*, 56*b* and 56*c* are different views of a cluster 32 of eight triangular bifacial polyhedrons 1 and six square bifacial polyhedrons 2 glued point-to-point in a truncated (at the corners) cubic configuration, the square bifacial polyhedrons 2 being the six faces of the cube 32 and the triangular bifacial polyhedrons 1 being the eight truncated corners of the cube 32. FIG. 57 depicts a ball-shaped cluster 33 of twenty triangular bifacial polyhedrons 1 and twelve pentagonal bifacial polyhedrons 3 glued together point-to-point in a pattern such that one point each of two opposed triangular bifacial polyherons 1 are attached to each other and to one point each of two opposed pentagonal bifacial polyhedrons 3 at each locus of glued attachment 37. FIG. 58 illustrates a spherical cluster 34 of twenty triangular bifacial polyhedrons 1, thirty square bifacial polyhedrons 2 and twelve pentagonal bifacial polyhedrons 3 glued together point-to-point in a pattern such that one point of each of two opposed square bifacial polyhedrons 2 are attached to each other and to one point each of a triangular bifacial polyhedron 1 and a pentagonal bifacial polyhedron 3 in positions opposed to each other at each locus of glued attachment 38.

Figure 59:
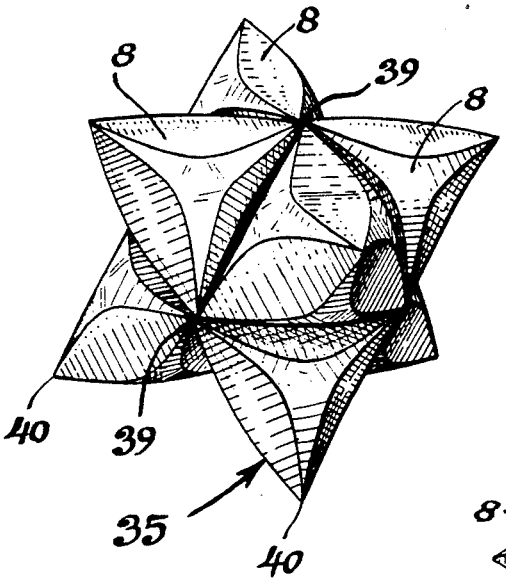
FIG. 59 is a perspective view of a cluster of eight tetrahedrons.
Figure 60:
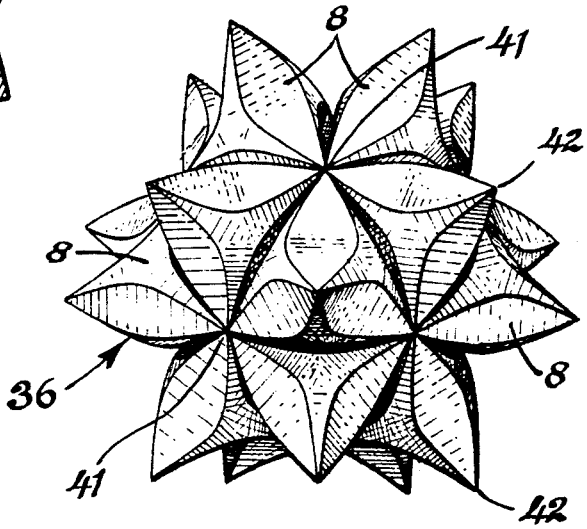
FIG. 60 is a perspective view of a cluster of twenty tetrahedrons.

Polyhedrons other than bifacial polyhedrons may be assembled into attractive clusters. For example, in FIG. 59, eight tetrahedrons 8 are glued together point-to-point in a cubic shaped cluster 35, one point of each of four tetrahedrons 8 being attached to each other at each locus of glued attachment 39 and one point 40 of each tetrahedron 8 being left outward-facing and unattached. In FIG. 60, twenty tetrahedrons 8 are glued together point-to-point in a dodecahedral shaped cluster 36 having pentagonally-shaped faces formed by each five tetrahedrons 8 glued together at each locus of glued attachment 41, one point 42 of each tetrahedron being left outward-facing and unattached.

While a preferred form of the invention has been described in the foregoing specification and drawings, it should be understood that various minor modifications may be made to the embodiment described herein without departing from the spirit and scope of the invention.

For example, while the preferred embodiment above described contemplates kits comprising one or a plurality of completely formed planar components of the general types described herein, such components may instead be presented as cut-outs or punch-outs from rectangular sheets, booklets, boxes and the like all without departing from the scope of the invention.

It will be understood that this invention will be otherwise embodied within the scope of the following claims.

I claim:

1. A construction kit for forming an entirely curvilinearly faced polyhedron, all surfaces of which are curved surfaces laterally define exclusively by arcs, from a plurality of polygonal planar components defined exclusively by arcuate edges and being scored exclusively along arcuate interior lines to form arcuately defined polygons to facilitate the folding and assembly of said components to form said polyhedron.

2. A construction kit for forming an entirely curvilinearly faced polyhedron, all surfaces of which are curved surfaces laterally defined exclusively by arcs, from a planar polygonal component defined exclusively by arcuate edges and being scored exclusively along arcuate interior lines to form arcuately defined polygons to facilitate the folding and assembly of said component to form said polyhedron.

3. The construction kit of claim 2 wherein the said polyhedron is an equilateral tetrahedron having four convexly-curved equilateral triangular faces having symmetrical inwardly-curved arcuate sides, each side of each said triangular face being separated from a side of an adjoining triangular face by one of six concavely curved two-sided lobes defined by two symmetrical outwardly-curved arcuate sides, the arcs defining the sides of the four triangular faces and six interspersed lobes being intersecting at each point of the tetrahedron.

4. A cluster of eight of the tetrahedrons of claim 3 glued together point-to-point in a cubic shapd cluster, one point of each of four of said tetrahedrons being attached to each other at each locus of glued attachment and one point of each tetrahedron being left outward-facing and unattached.

5. A cluster of twenty of the tetrahedrons of claim 3 glued together point-to-point in a dodecahedral configuration having pentagonally-shaped faces formed by each five tetrahedrons glued together at each locus of glued attachment, one point of each tetrahedron being left outward-facing and unattached.

6. A planar multilobate disc element of a kit for constructing curvilinear faced polyhedrons from stiff scorable sheet material, the outer edges of said element being from three to six identical symmetrical convex exterior arcs connected end-to-end in a closed chain, each of said exterior arcs being opposed by an identical scored concave interior arc, said interior arcs intersecting each other only at the aforesaid connected ends of said exterior arcs, whereby said scored interior arcs together with their respective opposed exterior arcuate edges of said element define a closed peripheral chain of from three to six congruent symmetrical two-pointed interiorly unscored lobes surrounding an interiorly unscored equilateral polygonal face, said element being readily foldable only along said scored interior arcs.

7. A planar multilobate disc element of a kit for constructing curvilinear faced polyhedrons from stiff scorable sheet material, the outer edges of said element being from three to five identical symmetrical convex exterior arcs connected end-to-end and in a closed chain, each of said exterior arcs being opposed by an identical scored concave interior arc, said interior arcs intersecting each other only at the aforesaid connected ends of said exterior arcs, whereby said scored interior arcs together with their respective opposed exterior arcuate edges of said element define a closed peripheral chain of from three to five congruent symmetrical two-pointed interiorly unscored lobes surrounding an interiorly unscored regular polygonal face, said element being readily foldable only along said scored interior arcs.

8. A planar disc element of claim 7 having three congruent symmetrical two-pointed interiorly unscored lobes surrounding an interiorly unscored equilateral triangular face.

9. A planar disc element of claim 8 wherein the midpoint width of each lobe is at least one eighth of the point-to-point length of the lobe.

10. A planar disc element of claim 9 wherein the midpoint width of each lobe is approximately one third of the point-to-point length of the lobe.

11. A planar disc element of claim 7 having four congruent symmetrical two-pointed interiorly unscored lobes surrounding an interiorly unscored square face.

12. A planar disc element of claim 11 wherein the midpoint width of each lobe is at least one eighth of the point-to-point length of the lobe.

13. A planar disc element of claim 7 having five congruent symmetrical two-pointed interiorly unscored lobes surrounding an interiorly unscored regular pentagonal face.

14. A planar disc element of claim 13 wherein the midpoint width of each lobe is approximately one third of the point-to-point length of the lobe.

15. A planar disc element of claim 6 having six congruent symmetrical two-pointed interiorly unscored lobes surrounding an interiorly unscored regular hexagonal face.

16. A planar disc element of claim 15 wherein the midpoint width of each lobe is approximately one third of the point-to-point length of the lobe.

17. A planar disc element of claim 6 having four congruent symmetrical two-pointed interiorly unscored lobes surrounding an interiorly unscored rhombic face, a point-to-point diagonal of said rhombus being equal in length to the point-to-point length of the lobes.

18. A planar disc element of claim 17 wherein the midpoint width of each lobe is approximately one third of the point-to-point length of the lobe.

19. A planar component of a kit for constructing curvilinear faced polyhedrons from stiff scorable sheet material, the outer edges of said component being a plurality of identical symmetrical convex exterior arcs connected end-to-end in a closed chain, each of said exterior arcs being opposed by an identical scored concave interior arc, said interior arcs intersecting each other only at the aforesaid connected ends of said exterior arcs, whereby the aforesaid scored interior arcs together with their respective opposed exterior arcuate edges of said component define a closed peripheral chain of congruent symmetrical two-pointed interiorly unscored lobes connected end-to-end, at least one of said end connections of said exterior lobes being further connected to at least one non-adjacent end connection of said exterior lobes by at least one bilaterally arcuately scored interior lobe which is also interiorly unscored and congruent to said exterior lobes, whereby said connected congruent exterior and interior lobes collectively define a plurality of interiorly unscored equilateral polygonal faces, each said polygonal face having from three to six sides, said component being readily foldable only along said scored interior arcs.

20. A planar component of claim 19 wherein each of the plurality of equilateral polygonal faces has from three to five sides.

21. A planar component of claim 20 wherein each of the plurality of equilateral polygonal faces is a regular polygon.

22. A planar component of claim 20 wherein at least one of the plurality of equilateral polygonal faces is a rhombus, a point-to-point diagonal of said rhombus being equal in length to the point-to-point length of its sides.

23. A planar component of claim 19 wherein the midpoint width of each of the connected congruent exterior and interior lobes is approximately one third of the point-to-point length of the lobe.

24. A planar component of claim 19, said component being readily foldable exclusively along its scored interior arcs into such a shape that each of its exterior lobes is in completely lapped relationship with another of its exterior lobes, whereby said component when so folded and lapped will form a closed polyhedron.

25. A planar component of claim 19 having two equilateral polygonal faces having equal numbers of sides, and one interior lobe, said component being readily foldable exclusively along its scored interior arcs into such a shape that each of its exterior lobes is in completely lapped relationship with another of its exterior lobes, whereby said component when so folded and lapped will form a closed bifacial polyhedron

26. A planar component of claim 21 having four interiorly unscored congruent triangular faces so arranged that said component, when folded along its scored interior arcs into such a shape that each of its exterior lobes is in completely lapped relationship with another of its exterior lobes, will form a closed regular tetrahedron.

27. A planar component of claim 19, said component being readily foldable exclusively along its scored interior arcs into such a shape that some, but not all of its exterior lobes can be in completely lapped relationship with others of its exterior lobes, said so folded and lapped component being capable of assembly into a closed polyhedron when each of its remaining unlapped exterior lobes are placed in lapped relationship with one of the congruent unlapped exterior lobes of at least one other folded component of claim 19.

28. A planar component of claim 19, said component being readily foldable exclusively along its scored interior arcs into such a shape that some, but not all of its exterior lobes can be in completely lapped relationship with others of its exterior lobes, said so folded and lapped component being capable of assembly into a closed polyhedron when each of its remaining unlapped exterior lobes are placed in lapped relationship with one of the congruent unlapped exterior lobes of at least one folded planar multilobate disc element having from three to five lobes surrounding an interiorly unscored equilateral polygonal face.

29. A closed curvilinear faced polyhedron formed from stiff scorable planar material, said material having been scored and folded exclusively along a plurality of identical symmetrical arcs to define a plurality of faces of said polyhedron, each said face being an interiorly unscored equilateral polygon having from three to six curvilinear side edges curved concavely relative to the center of said polygonal face, each said face being curved convexly relative to the center of said polyhedron and being in point-to-point contact with at least one other face of said polyhedron, each side edge of each said face being separated from a side edge of an adjacent face by an interiorly unscored symmetrical two-pointed lobe having convexly curved side edges, all of said lobes of said polyhedron being congruent and curved concavely relative to the center of said polyhedron.

30. A closed curvilinear faced polyhedron of claim 29 having two opposed polygonal faces, each said face having an equal number of side edges.

31. A closed curvilinear faced polyhedron of claim 29 wherein each said face is an equilateral polygon having from three to five curvilinear side edges.

32. A closed curvilinear faced polyhedron of claim 31 having two opposed congruent regular polygonal faces.

33. A closed curvilinear faced polyhedron of claim 31 wherein each said face is a regular polygon.

34. A closed curvilinear faced polyhedron of claim 33 wherein some of said polygonal faces are depressed concavely relative to the center of the polyhedron whereby each said face so depressed combines with its adjacent concave lobes to form an extended concave face having side edges curved convexly relative to the center of said polygonal face and is, therefore, unseparated from the side edges of adjacent convex faces by separate lobes.

35. A kit for forming a closed curvilinear faced polyhedron of claim 34 wherein some of the interior arcs of the components of said kit which would be scored to form a polyhedron having entirely convex faces, are left unscored to facilitate the result of claim 34.

36. A kit for forming a closed curvilinear faced polyhedron of claim 34 wherein some of the disc elements of said kit are provided with no scored concave interior arcs, and, therefore, no peripheral lobes in order to facilitate the result of claim 34.

37. A closed curvilinear faced monohedron formed by folding a planar multilobate disc element of claim 6 having an even number of sides along its scored interior arcs and bending said element about one of its diagonals to bring each of its peripheral lobes into lapped relationship with another of its peripheral lobes.

38. A planar multilobate disc element of claim 6 printed on at least one face thereof.

39. A planar component of claim 19 printed on at least one face thereof.

40. A hollow cluster of selected bifacial polyhedrons of claim 32 glued together point-to-point, from three to five of said bifacial polyhedrons being so connected at each point of glued attachment.

* * * * *